US011746737B2

(12) United States Patent
Irie

(10) Patent No.: US 11,746,737 B2
(45) Date of Patent: Sep. 5, 2023

(54) IGNITION APPARATUS FOR INTERNAL COMBUSTION ENGINE

(71) Applicant: DENSO CORPORATION, Kariya (JP)

(72) Inventor: Masashi Irie, Kariya (JP)

(73) Assignee: DENSO CORPORATION, Kariya (JP)

( * ) Notice: Subject to any disclaimer, the term of this patent is extended or adjusted under 35 U.S.C. 154(b) by 14 days.

(21) Appl. No.: 17/231,259

(22) Filed: Apr. 15, 2021

(65) Prior Publication Data

US 2021/0324826 A1 Oct. 21, 2021

(30) Foreign Application Priority Data

Apr. 16, 2020 (JP) ..... 2020-073600

(51) Int. Cl.
*F02P 3/05* (2006.01)
*F02P 3/055* (2006.01)

(52) U.S. Cl.
CPC ..... *F02P 3/051* (2013.01); *F02P 3/0554* (2013.01)

(58) Field of Classification Search
CPC ..... H03K 2017/0806; F02P 3/051; F02P 3/0554; G01R 31/2619; G01R 31/2628; H02H 5/04
USPC ..... 324/762.08, 762.09; 123/644
See application file for complete search history.

(56) References Cited

U.S. PATENT DOCUMENTS 5,696,452 A * 12/1997 Hemmenway ..... G01R 31/2621 324/762.09
7,486,099 B1 * 2/2009 Manika ..... G01R 31/42 324/762.08
2005/0269674 A1 12/2005 Kawakita et al.
2013/0060499 A1 * 3/2013 Yoshimura ..... G01K 7/01 702/99
2016/0260650 A1 * 9/2016 Taguchi ..... B60L 15/007
2018/0097514 A1 * 4/2018 Ishii ..... F02P 3/053
2019/0356128 A1 * 11/2019 Shimizu ..... H03K 17/08116

FOREIGN PATENT DOCUMENTS

JP 2009-275629 11/2009

* cited by examiner

*Primary Examiner* — Logan M Kraft
*Assistant Examiner* — Joshua Campbell
(74) *Attorney, Agent, or Firm* — Nixon & Vanderhye P.C.

(57) ABSTRACT

In an ignition apparatus, a deterioration determination circuit performs a deterioration determination task of (i) monitoring an absolute increase in a temperature parameter during a predetermined deterioration detection period that has been started since an energization command signal being inputted to a control circuit, and (ii) performing a comparison between the absolute increase in the temperature parameter and a predetermined deterioration detection threshold to thereby determine whether a level of deterioration of a switching circuit is within an acceptable level.

8 Claims, 12 Drawing Sheets

IGNITION APPARATUS FOR INTERNAL COMBUSTION ENGINE

CROSS REFERENCE TO RELATED APPLICATIONS

This application is based on and claims the benefit of priority from Japanese Patent Application Publication No. 2020-073600 filed on Apr. 16, 2020, the disclosure of which is incorporated in its entirety herein by reference.

TECHNICAL FIELD

The present disclosure relates to ignition apparatuses for internal combustion engines.

BACKGROUND

Ignition apparatuses for an internal combustion engine include an igniter comprised of a switch. The igniter controls the switch for applying a high voltage to an ignition plug of the internal combustion engine.

SUMMARY

According to an exemplary aspect of the present disclosure, there is provided an ignition apparatus. The ignition apparatus includes a deterioration determination circuit that performs a deterioration determination task. The deterioration determination task monitors an absolute increase in a temperature parameter during a predetermined deterioration detection period that has been started since an energization command signal being inputted to a control circuit. Then, the deterioration determination task performs a comparison between the absolute increase in the temperature parameter and a predetermined deterioration detection threshold to thereby determine whether a level of deterioration of a switching circuit is within an acceptable level.

DETAILED DESCRIPTION OF EMBODIMENTS

Figure 1:
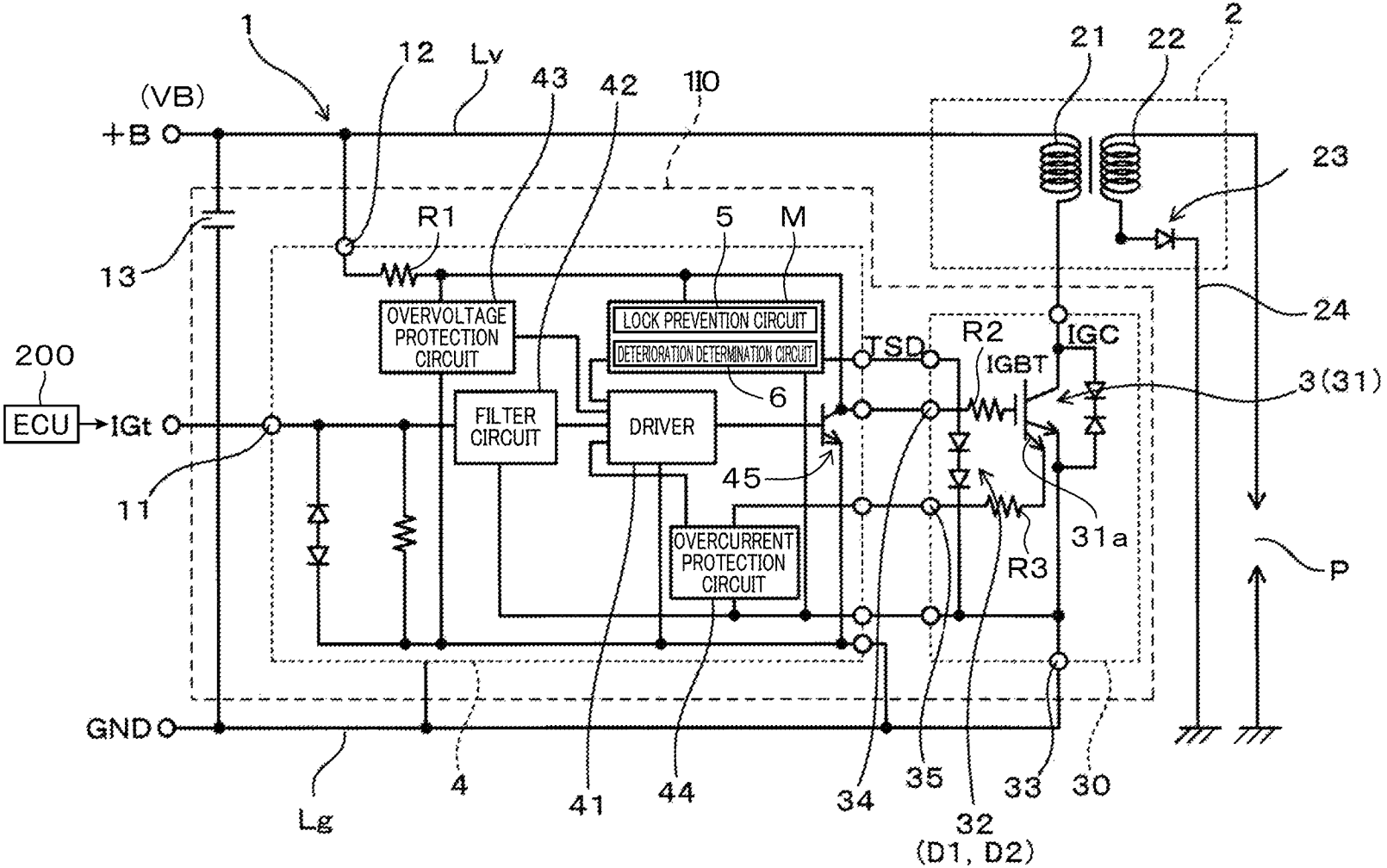
FIG. 1 is a circuit block diagram schematically illustrating an example of the configuration of an ignition apparatus according to the first embodiment of the present disclosure.

Typical ignition apparatuses for an internal combustion engine include an ignition coil and an igniter serving as an ignition controller. The igniter controls energization of the ignition coil, so that the energized ignition coil outputs a high voltage for igniting an ignition plug of the internal combustion engine.

The igniter includes, for example, a switch, such as an insulated gate bipolar transistor (IGBT), and a control circuit for controlling on-off switching operations of the switch. The ignition coil is comprised of a primary coil and a secondary coil, and the switch is connected to the primary coil. The secondary coil is connected to the ignition plug. The control circuit turns on the switch to energize the primary coil, and thereafter turns off the switch to deenergize the primary coil to accordingly induce a high voltage across the secondary coil based on electromagnetic induction. The generated high voltage is applied across the ignition plug, so that the high voltage applied across the ignition plug causes the ignition plug to generate a spark discharge.

Such a control circuit included in an igniter can have an overtemperature protection function of preventing the switch from overtemperature.

For example, Japanese Patent Application Publication No. 2006-19700 discloses such an igniter, which is an example of a semiconductor apparatus, having such an overtemperature protection function.

The igniter disclosed in the patent publication includes first and second lead frames that are separately arranged from each other. The igniter includes a semiconductor switch that is frequently switched for energization of an ignition coil and mounted on the first lead frame. The igniter includes a comparative semiconductor device mounted on the second lead frame; the comparative semiconductor device has an operating temperature that is lower than that of the semiconductor switch.

Additionally, a thermal resistance member is arranged between the first lead frame and the second lead frame to reduce thermal transfer from the first lead frame to the second lead frame.

The comparative semiconductor device serves as a comparator and performs such an overtemperature protection function of protecting the semiconductor switch against overtemperature.

Specifically, the comparative semiconductor device performs the overtemperature protection function to thereby (1) Compare a temperature of the semiconductor switch with a reference temperature (2) Determine that the semiconductor switch is likely to be in an overtemperature state upon determination that the temperature of the semiconductor switch is higher than the reference temperature (3) Shut off energization of the semiconductor switch, i.e. turn off the semiconductor switch, in response to determination that the temperature of the semiconductor switch is higher than the reference temperature to accordingly prevent the semiconductor switch from being in the overtemperature state, making it possible to protect the semiconductor switch against deteriorations due to its overtemperature (4) Permit energization of the semiconductor switch, i.e. permit turn-on of the semiconductor switch in response to determination that the temperature of the semiconductor switch is maintained to be lower or equal to the reference temperature Such a comparative semiconductor device, which has the overtemperature protection function, is usually designed not to perform the overtemperature protection function while the semiconductor switch is in a normal operation state. Note that the semiconductor switch is determined to be in the normal operation state as long as the semiconductor switch is switched on or off with its on duration maintained within a predetermined normal on-duration threshold.

That is, the comparative semiconductor device is designed to perform the overtemperature protection function in response to determination that the semiconductor switch is in a specific operation state, in other words, the on duration of the semiconductor switch has exceeded the predetermined normal on-duration threshold. Note that a switch, which is in a state where its on duration has exceeded the predetermined normal on-duration threshold, will be referred to as the switch being locked, i.e. frozen, in the on state.

How the temperature of a switch increases depends on not only its energized time but also its mounted state on a circuit board, such as a lead frame set forth above. In particular, how the temperature of a switch increases is likely to be susceptible to its heat-dissipation change with age.

A switch, such as a semiconductor switch for energization of an ignition coil, is usually mounted on a circuit board with adhesive, such as solder paste. This configuration enables heat generated from the switch to be dissipated to the circuit board via the adhesive. A progression of deterioration of the adhesive with long-term use of the switch may cause cracks in the adhesive to increase, resulting in the heat dissipation of the switch becoming deteriorated.

Such deterioration of the heat dissipation of the semiconductor switch disclosed in the patent publication may cause the temperature of the semiconductor switch to be likely to increase even if the semiconductor switch is in the normal operation state. This may result in the temperature of the semiconductor switch exceeding the reference temperature, causing unexpected execution of the overtemperature protection function. This unexpected execution of the overtemperature protection function may cause unscheduled shutdown of energization of the semiconductor switch.

This unscheduled shutdown of energization of the semiconductor switch may result in turn-off of the semiconductor switch being earlier than a proper turn-off timing, resulting in the ignition plug being ignited earlier than properly scheduled, in other words, resulting in preignition of the ignition plug. This preignition of the ignition plug may result in damage to components constituting the internal combustion engine.

From the above viewpoints, the present disclosure seeks to provide ignition devices, each of which is capable of reducing unexpected execution of such an overtemperature protection function.

An ignition apparatus according to an exemplary aspect of the present disclosure aims to control energization of a primary winding of an ignition coil to accordingly generate an ignition voltage across a secondary winding of the ignition coil. The ignition apparatus includes a switching circuit including a switch connected to the primary winding, and a control circuit. The control circuit includes a driver configured to control energization of the switch in response to an energization command signal inputted thereto. The control circuit includes an overtemperature protection circuit.

The overtemperature protection circuit is configured to (i) monitor a temperature parameter representing a temperature of the switch, (ii) cause the driver to energize the switch upon determination that the temperature of the switch obtained based on the monitored temperature parameter is lower than or equal to a predetermined prevention temperature, and (iii) cause the driver to shut down the energization of the switch upon determination that the temperature of the switch obtained based on the monitored temperature parameter is higher than the predetermined prevention temperature.

The control circuit includes a deterioration determination circuit configured to perform a deterioration determination task.

The deterioration determination task monitors an absolute increase in the temperature parameter signal during a predetermined deterioration detection period that has been started since the energization command signal being inputted to the control circuit. The deterioration determination task performs a comparison between the absolute increase in the temperature parameter signal and a predetermined deterioration detection threshold to thereby determine whether a level of deterioration of the switching circuit is within an acceptable level.

The overtemperature protection circuit of the ignition apparatus according to the exemplary embodiment causes the driver to shut down the energization of the switch upon determination that the temperature of the switch obtained based on the monitored temperature parameter is higher than the predetermined prevention temperature. This configuration therefore protects the switch against overtemperature.

Additionally, the deterioration determination circuit of the ignition apparatus according to the exemplary embodiment is configured to 1. Monitor the absolute increase in the temperature parameter during the predetermined deterioration detection period that has been started since the energization command signal being inputted to the control circuit 2. Perform a comparison between the absolute increase in the temperature parameter and a predetermined deterioration detection threshold to thereby determine whether the level of deterioration of the switching circuit is within the acceptable level.

This configuration makes it possible to determine whether the level of deterioration of the switching circuit is within the acceptable level before the switch is shut down by the overtemperature protection circuit. This therefore reduces execution of the ignition operation at an unscheduled timing.

The following describes exemplary embodiments of the present disclosure with reference to the accompanying drawings. In the embodiments, like parts between the embodiments, to which like reference characters are assigned, are omitted or simplified to avoid redundant description.

First Embodiment

The following describes an ignition apparatus 1 for an internal combustion engine 100 with an ignition plug P according to the first embodiment of the present disclosure with reference to FIGS. 1 to 6.

The internal combustion engine 100, which will be referred to simply as an engine 100, is a vehicular engine installed in, for example, a vehicle, and the ignition plug P is provided in a combustion chamber of the engine 100.

Referring to FIG. 1, the ignition apparatus 1 has a main power supply terminal +B to which electrical power, i.e. a drive voltage, VB is supplied from an unillustrated power source, and has a ground terminal GND. The ignition apparatus 1 aims to apply, based on the supplied drive voltage VB, a high voltage to the ignition plug P to thereby generate a spark discharge in the ignition plug P. This results in a gas mixture, such as an air-fuel mixture, in the combustion chamber igniting.

FIG. 1 also illustrates an electronic control unit (ECU) 200 for controlling operations of the engine 100. The ECU 200 cyclically outputs an ignition signal IGt serving as an energization command signal to the ignition apparatus 1, and the ignition apparatus 1 controls, based on the ignition signal IGt inputted thereto, the timing to cause a spark discharge in the ignition plug P.

The ignition apparatus 1 includes an ignition coil 2 comprised of (i) a primary winding 21 and a secondary winding 22, and (ii) an igniter 10 comprised of a switching circuit 30 and a control circuit 4.

Each of the primary and secondary windings 21 and 22 has a first end, i.e. a high-voltage end, and a second end, i.e. a ground-side end, opposite to each other, and the first end of the secondary winding 22 is connected to the ignition plug P. The primary and secondary windings 21 and 22 can be magnetically coupled with each other.

Note that, in the specification, a connection between components represents at least an electrical connection therebetween or both an electrical connection and a mechanical connection.

The ignition apparatus 1 has a power supply line Lv and a ground line Lg, each of which has opposing first and second ends, and the first end of the power supply line Lv is connected to the main power supply terminal +B, and the second end thereof is connected to the first end of the primary winding 21. This enables the main electrical power, i.e. drive voltage VB, supplied from the unillustrated power source to be applied to the first end of the primary winding 21 via the power supply line Lv. The first end of the ground line Lg is connected to a ground terminal GND of the ignition apparatus 1.

As described later, the igniter 10 controls the amount of a current flowing through the primary winding 21 to thereby induce, based on the main electrical power, i.e. drive voltage VB, supplied from the unillustrated power source, a high voltage through the secondary winding 22 for generation of a spark discharge in the spark plug P.

The switching circuit 30 of the control circuit 4 has plural terminals that include a coil terminal IGC, a power terminal 12, a ground terminal 33, a gate terminal 34, and a current detection terminal 35.

The switching circuit 30 is for example designed as a single semiconductor chip with a circuit board, and is comprised of, for example, a switch 3 and a temperature sensor 32 mounted on the circuit board in the single semiconductor chip with adhesive, such as solder paste. The temperature sensor 32 aims to measure the temperature of the switch 3.

The control circuit 4 aims to control on-off switching operations of the switch 3, in other words, to control energization or de-energization of the switch 3.

For example, the switch 3 has a first input/output (I/O) terminal, a second I/O terminal, and a control terminal. The first embodiment uses an insulated gate bipolar transistor (IGBT) 31 as the switch 3. Specifically, the IGBT 31 has a collector as the first I/O terminal, an emitter as the second I/O terminal, and a gate as the control terminal. The IGBT 31 also has a sense terminal 31*a*.

The collector of the IGBT 31 is connected to the second end of the primary winding 21, and the emitter of the IGBT 31 is connected to the ground terminal GND of the ignition apparatus 1 via the ground terminal 33 and the ground line Lg. The IGBT 31 includes diodes whose cathodes are connected to each other; the diodes are provided between the collector and emitter of the IGBT 31.

The control circuit 4 is configured to receive the ignition signal IGt sent from the ECU 200, and control, based on the ignition signal IGt, on-off switching operations of the IGBT 31 to thereby control how the ignition plug P generates a spark discharge.

Specifically, the ignition signal IGt is, for example, a pulse signal having a high level indicative of turn-on of the IGBT 31 or a low level indicative of turn-off of the IGBT 31.

Specifically, the control circuit 4 has plural terminals that include an input terminal 11, a detection terminal TSD, and a ground terminal GND, and includes, for example, a switch control circuit module M comprised of a lock prevention circuit 5 serving as an overheat prevention circuit and a deterioration determination circuit 6.

Figure 2:
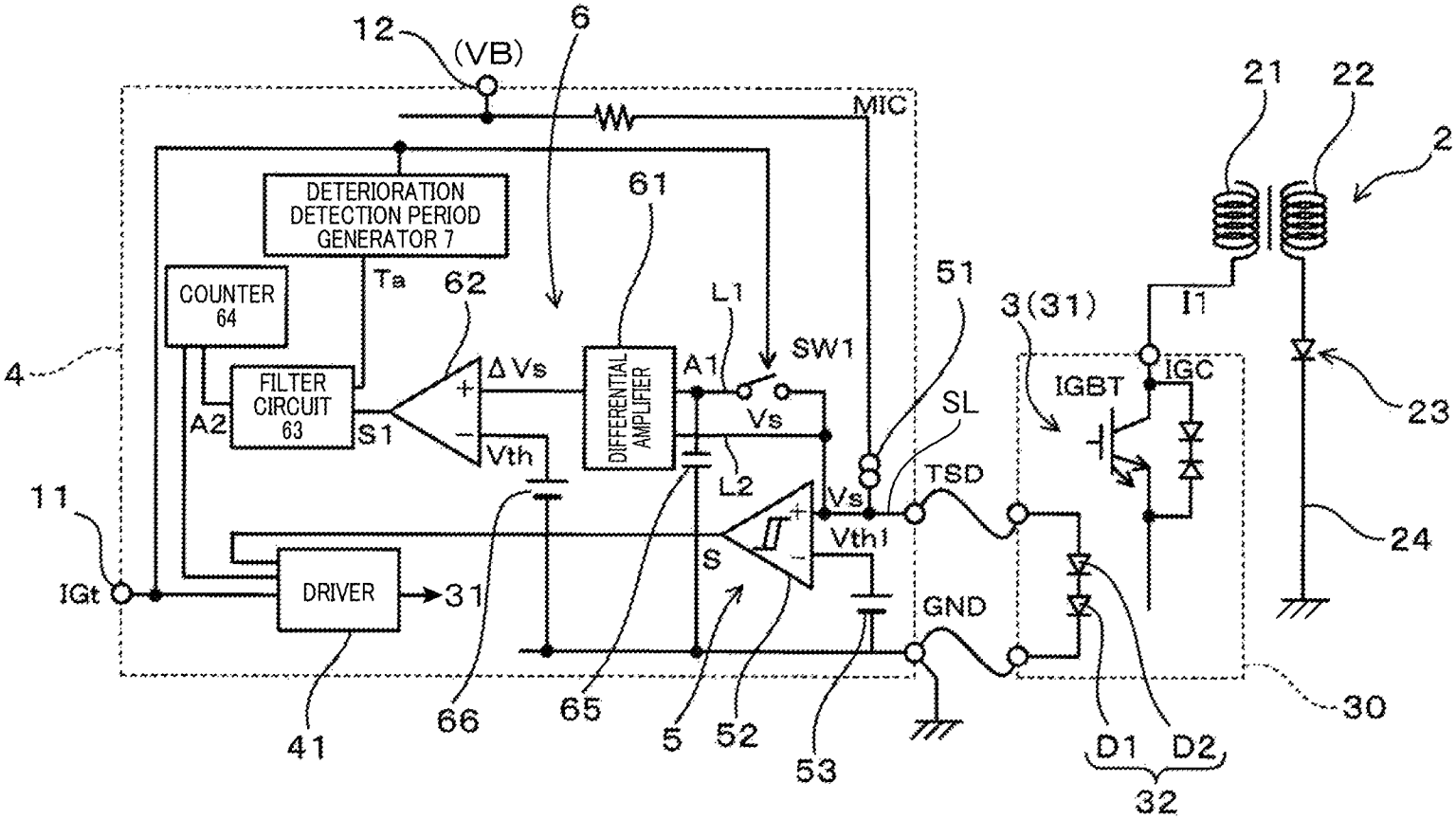
FIG. 2 is a circuit diagram schematically illustrating selected components of a lock protection circuit and selected components of a deterioration determination circuit of the ignition apparatus illustrated in FIG. 1.

Referring to FIG. 2, a detection voltage Vs, which serves as a switch-temperature parameter, i.e. an electrical signal of the switch-temperature parameter indicative of the temperature of the IGBT 31 (switch 3), is inputted to the lock prevention circuit 5 of the control circuit 4. The lock prevention circuit 5 aims to prevent, based on the detection voltage Vs, the IGBT 31 from overtemperature to accordingly protect the IGBT 31 against overtemperature.

Specifically, the lock prevention circuit 5 of the first embodiment is designed as a thermal-shutdown lock prevention circuit 5 to 1. Monitor the detection voltage Vs 2. Determine whether the monitored detection voltage Vs has exceeded a predetermined energization prevention temperature threshold T1

3. Output, to a driver 41 described later, an overtemperature detection signal S upon determination that the monitored detection voltage Vs has exceeded the predetermined energization prevention temperature threshold T1 for shutdown of energization of the IGBT 31

The temperature sensor 32 is configured to measure the temperature of the IGBT 31 (switch 3), and output, to each of the lock prevention circuit 5 and the deterioration determination circuit 6, the switch-temperature parameter signal that includes the detection voltage Vs that serves as a parameter representing the temperature of the IGBT 31 (switch 3).

Figure 4:
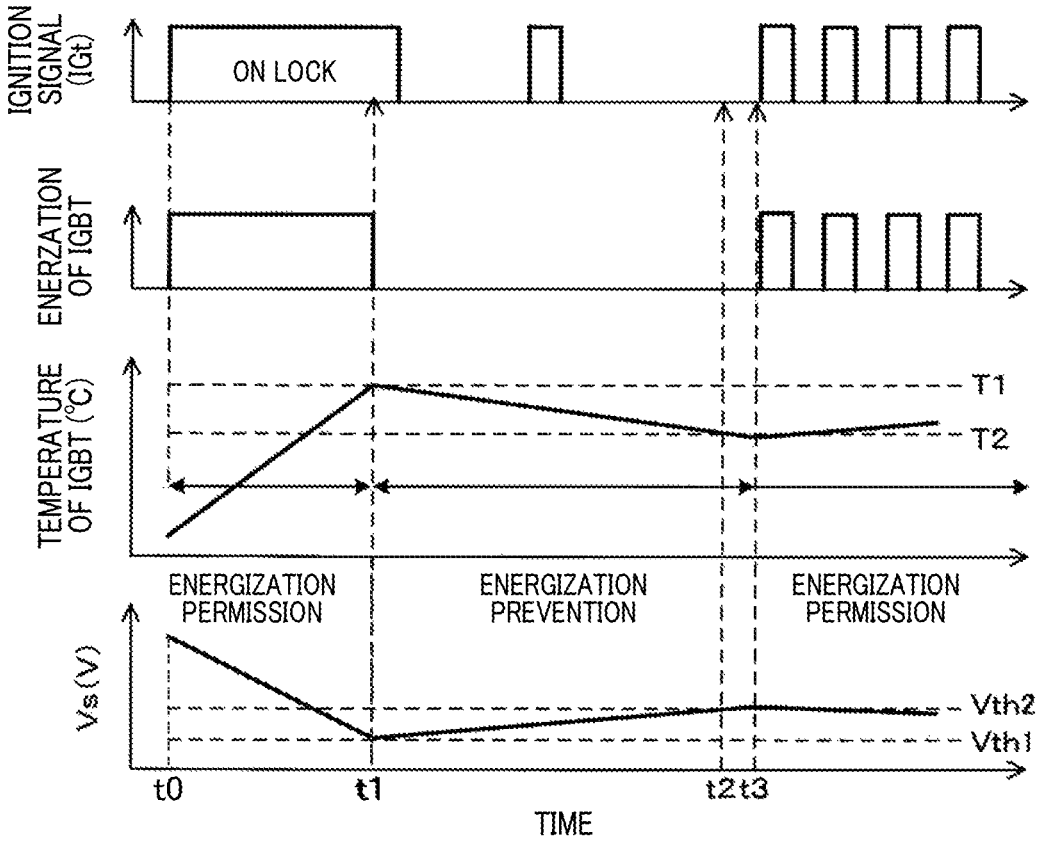
FIG. 4 is a joint timing chart schematically illustrating how the lock protection circuit works according to the first embodiment.

As illustrated in FIG. 4, the energization prevention temperature threshold T1 represents an upper limit temperature for the IGBT 31, i.e., the switch 3, so that energization of the IGBT 31 is enabled as long as the temperature of the IGBT 31 is maintained to be lower than or equal to the energization prevention temperature threshold T1. Specifically, the lock prevention circuit 5 is configured to estimate, based on the detection voltage Vs, a value of the temperature of the IGBT 31, and control energization of the IGBT 31 to thereby maintain the estimated value of the temperature of the IGBT 31 to be lower than or equal to the energization prevention temperature threshold T1. For example, a value of the energization prevention temperature threshold T1 can be set to be lower than an upper-temperature limit of the IGBT 31; the upper-temperature limit of the IGBT 31 is determined beforehand based on the specifications of the IGBT 31.

Like the lock prevention circuit 5, the detection voltage Vs, which serves as the switch-temperature parameter signal indicative of the temperature of the IGBT 31 (switch 3), is inputted to the deterioration determination circuit 6.

The deterioration determination circuit 6 is configured to monitor, based on the detection voltage Vs, how the temperature of the IGBT 31 (switch 3) increases to accordingly detect a level of deterioration of the switching circuit 30.

Specifically, the deterioration determination circuit 6 is configured to

1. Calculate, in response to the input of the ignition signal IGt to the control circuit 4, an initial value of the detection voltage Vs at the input of the ignition signal IGt at the input of the ignition signal IGt; the initial value of the detection voltage Vs corresponds to an initial value of the temperature of the IGBT 31 (switch 3) at the input of the ignition signal IGt 2. Cyclically monitor the detection voltage Vs during a predetermined deterioration detection period Ta that has been started since the input of the ignition signal IGt to the control circuit 4 to accordingly calculate, for each cycle, an absolute increase ΔVs in the detection voltage Vs relative to the initial value of the detection voltage Vs; the absolute increase ΔVs in the detection voltage Vs relative to the initial value of the detection voltage Vs corresponds to an absolute increase in the temperature of the IGBT 31 (switch 3) relative to the initial value of the temperature of the IGBT 31 (switch 3).

The absolute increase ΔVs in the detection voltage Vs will be referred to as a temperature-parameter increase ΔVs.

The deterioration determination circuit 6 is also configured to

1. Perform a comparison of the temperature-parameter increase ΔVs calculated for each cycle with a deterioration detection threshold Vth previously determined for the switching circuit 30

2. Determine, based on the comparison result for each cycle, whether to output a deterioration detection signal S1 to the driver 41 via a filter circuit described later As illustrated in FIGS. 5 and 6, the deterioration detection period Ta is set within a high-level duration of the ignition signal IGt. Additionally, as illustrated in FIGS. 5 and 6, the deterioration detection period Ta is preferably set such that the deterioration detection signal S1 is outputted before the temperature of the IGBT 31 (switch 3) estimated based on the detection voltage Vs reaches a predetermined energization prevention temperature T1. This setting of the deterioration detection period Ta enables an estimated temperature of the IGBT 31 (switch 3) based on the deterioration detection threshold Vth to be lower than the energization prevention temperature T1, making it possible to detect an abnormal increase in the temperature of the IGBT 31 (switch 3) due to, for example, a partial deterioration of the switching circuit 30 before the lock prevention circuit 5 shuts down energization of the IGBT 31, i.e., the switch 3.

Referring to FIG. 2, the deterioration determination circuit 6 preferably includes a deterioration detection period generator 7, a switch SW1, a differential amplifier 61 serving as a temperature increment calculator, a comparator 62, a filter circuit 63, a counter 64, a capacitor 65, and a voltage source 66.

The deterioration detection period generator 7 triggers generation of the deterioration detection period Ta in response to the input of the ignition signal IGt to the control circuit 4. The differential amplifier 61 calculates, in response to the input of the ignition signal IGt to the control circuit 4, the initial value of the temperature of the IGBT 31 at the input of the ignition signal IGt, and calculates, for each cycle, the temperature-parameter increase ΔVs relative to the initial value of the detection voltage Vs.

The comparator 62 compares the temperature-parameter increase ΔVs with the deterioration detection threshold Vth to accordingly determine whether the temperature-parameter increase ΔVs becomes higher than the deterioration detection threshold Vth. Then, the comparator 62 outputs the deterioration detection signal S1 to the filter circuit 63 upon determination that the temperature-parameter increase ΔVs becomes higher than the deterioration detection threshold Vth.

The filter circuit 63 is configured to enable the deterioration detection signal S1 to be passed therethrough to the counter 64 upon a signal representing the deterioration detection period Ta being outputted from the deterioration detection period generator 7 to the control circuit 4. Operations of the counter 64 will be described later.

This configuration of the control circuit 4 generates the deterioration detection period Ta, which has a predetermined length, immediately in response to the input of the ignition signal IGt to the control circuit 4, calculates the temperature increase ΔV, and compares the temperature increase ΔV with the deterioration detection threshold Vth.

This configuration of the control circuit 4 enables output of warning information representing that the switching circuit 3 has deteriorated upon determination that the temperature increase ΔV becomes higher than the deterioration detection threshold Vth within the generated deterioration detection period Ta.

In other words, this configuration of the control circuit 4 disables output of warning information representing that the switching circuit 3 has deteriorated even upon determination that the temperature increase ΔV becomes higher than the deterioration detection threshold Vth after termination of the generated deterioration detection period Ta.

This configuration of the control circuit 4 therefore makes it possible to immediately detect deterioration of the switching circuit 3, and notify one or more occupants in the vehicle of the warning information about the deterioration of the switching circuit 3.

The following describes the configuration and operations of the ignition apparatus 1 according to the first embodiment in more detail.

As described above, the igniter 10 of the ignition apparatus 1 is configured to perform on-off switching operations of the IGBT 31 (switch 3) in response to the ignition signal IGt send from the ECU 200 and inputted to the input terminal 11 of the control circuit 4 of the igniter 10.

The second end of the primary winging 21 is connected to the collector (first I/O terminal) of the IGBT 31 via the coil terminal IGC.

The first embodiment uses a vehicular battery installed in the vehicle as the unillustrated power source.

The ignition plug P has a center electrode and a ground electrode with a gap therebetween.

The first end of the secondary winding 22 is connected to the center electrode of the ignition plug P, and the ground electrode of the ignition plug P is connected to a ground of the engine 100. The second end of the secondary winding 22 is also connected to the ground of the engine 100 via a diode 23 for prevention of flying sparks.

The ignition coil 2 is configured such that shutting down energization of the primary winding 21 induces a high voltage across the secondary winding 22 based on electromagnetic induction, and applies the high voltage across the center and ground electrodes of the ignition plug P, thus causing a spark discharge to be generated therebetween.

The anode of the diode 23 is connected to the second end of the secondary winding 22, and the cathode of the diode 23 is connected to the ground of the engine 100. In other words, the diode 23 is connected between the secondary winding 22 and the predetermined ground of the engine 100 with its forward direction being directed from the secondary winding 22 to the ground of the engine 100. That is, the diode 23 disables a current generated due to energization of the primary winding 21 from flowing toward the second end of the secondary winding 22 from the ground of the engine 100, thus preventing flying sparks in the ignition plug P due to energization of the primary winding 21.

The temperature sensor 32 according to the first embodiment is comprised of a temperature-sensitive sensor including, for example, at least a first temperature-sensitive diode D1 and a second temperature-sensitive diode D2 connected in series to each other.

For example, the temperature sensor 32 according to the first embodiment is arranged to be adjacent to the IGBT 31, so that the temperature of the IGBT 31 is substantially identical to that of the temperature sensor 32.

The temperature sensor 32 is comprised of a temperature-sensitive sensor including, for example, at least a first temperature-sensitive diode D1 and a second temperature-sensitive diode D2. Specifically, the anode of the first temperature-sensitive diode D1 is connected to the cathode of the second temperature-sensitive diode D2, so that they are connected in series to each other. The cathode of the first temperature-sensitive diode D1 is connected to the ground terminal GND of the control circuit 4, and the anode of the second temperature-sensitive diode D2 is connected to the detection terminal TSD of the control circuit 4. This results in the direction from the anode of the second temperature-sensitive diode D2 toward the ground terminal GND of the control circuit 4 corresponding to the forward direction of each of the first and second temperature-sensitive diodes D1 and D2.

Each of the first and second temperature-sensitive diodes D1 and D2 is configured to generate a forward voltage thereacross upon a forward current is flowing therethrough; the forward voltage generated across each of the first and second temperature-sensitive diodes D1 and D2 correlates with the temperature thereof. That is, the higher the temperature of each of the first and second temperature-sensitive diodes D1 and D2, the lower the forward voltage across the corresponding one of the first and second temperature-sensitive diodes D1 and D2. This enables the control circuit 4 to measure, based on the forward voltage, which serves as the detection voltage Vs, of each of the first and second temperature-sensitive diodes D1 and D2, the temperature of the corresponding one of the first and second temperature-sensitive diodes D1 and D2, thus measuring the temperature of the IGBT 31 (switch 3).

The control circuit 4 is for example designed as a monolithic integrated circuit (IC), and is comprised of a single semiconductor chip with a circuit board, the lock prevention circuit 5, and the deterioration determination circuit 6 mounted on the circuit board in the single semiconductor chip. The lock prevention circuit 5 preferably includes the driver 41, a filter circuit 42, an overvoltage protection circuit 43, an overcurrent protection circuit 44, and a switch 45.

The filter circuit 42 is configured to shape the waveform of the ignition signal IGt transmitted from the ECU 200 to remove noise therefrom, thus outputting, to the driver 41, a binary signal with one of the high level and low level as the ignition signal IGt. The binary signal outputted from the filter circuit 42 can also be referred to as the ignition signal IGt. Note that an input of the ignition signal IGt to a given component represents that the ignition signal IGt with the high level is inputted to the given component, and shut down of the ignition signal IGt to a given component represents that the ignition signal IGt with the low level is inputted to the given component.

For example, a bipolar transistor is used as the switch 45. Specifically, the switch 45 has a collector as a first I/O terminal, an emitter as a second I/O terminal, and a base as a control terminal.

The driver 41 has an output terminal connected to the base, i.e. control terminal, of the switch 45, and the collector (first I/O terminal) of the switch 45 is connected to the power supply line Lv via the overvoltage protection circuit 43, a resistor R1, and the power terminal 12 of the control circuit 4. The emitter (second I/O terminal) of the switch 45 is connected to the ground terminal GND via the ground line Lg.

The collector (first I/O terminal) of the switch 45 is connected to the gate (control terminal) of the IGBT 31 via the gate terminal 34 of the switching circuit 30 and a resistor R2.

The driver 41 is configured to output, to the base of the switch 45, an energization signal, i.e. a turn-on signal, in response to the on duration of the ignition signal IGt inputted thereto from the filter circuit 42. This turns off the switch 45 to thereby apply the drive voltage VB supplied from the unillustrated power source to the gate of the IGBT 31, thus turning on the IGBT 31.

In contrast, the driver 41 is configured to output, to the base of the switch 45, a shutdown signal, i.e. a turn-off signal, in response to the off duration of the ignition signal IGt inputted thereto from the filter circuit 42. This turns on the switch 45 to thereby shut down the drive voltage VB from the unillustrated power source to the gate of the IGBT 31, thus turning on the IGBT 31.

That is, alternately controlling the high level or low level of the ignition signal IGt enables the IGBT 31 to be alternately turned on or off.

The overvoltage protection circuit 43 is connected between the power supply line Lv and the ground line Lg, and also connected between the power supply line Lv and the driver 41. The overvoltage protection circuit 43 is configured to monitor how the drive voltage VB supplied from the unillustrated power source via the power supply line Lv is changed, and to forcibly shut down the drive voltage VB from the unillustrated power source to the driver 41 upon detecting an overvoltage based on change of the drive voltage VB. This makes it possible to protect the switching circuit 3 against the overvoltage.

The overcurrent protection circuit 44 is connected between the current detection terminal 35 of the switching circuit 30 and the ground line Lg; the current detection terminal 35 of the switching circuit 30 is connected to the sense terminal 31*a* of the IGBT 31 via a resistor R3. The sense terminal 31*a* of the IGBT 31 enables a minute current, i.e. a sense current, to flow upon a collector current flowing through the IGBT 31.

Specifically, as illustrated in FIG. 1, the drive voltage VB applied to the first end of the primary winding 21 with the IGBT 31 being on enables a primary current to flow through the primary winding 21 and flow through the IGBT 31 as a collector current to the ground terminal GND. This enables the sense current to flow from the sense terminal 31*a* of the IGBT 31 into the overcurrent protection circuit 44. The overcurrent protection circuit 44 is connected to the driver 41.

The overcurrent protection circuit 44 is therefore configured to monitor how the primary current flowing through the primary winding 21 is changed, and to output, to the driver 41, information indicative of the occurrence of an overcurrent upon detecting the overcurrent based on change of the primary current. This enables the driver 41 to control on-off switching operations of the switch 45, i.e. the IGBT 31, to thereby limit the level of the primary current flowing through the primary winding 21. This makes it possible to protect the switching circuit 3 against the overcurrent.

The control circuit 3 additionally includes a capacitor 13 connected between the main power supply terminal +B and the ground terminal GND for preventing high-frequency noise components from flowing into the control circuit 4.

The lock prevention circuit 5 performs an overtemperature protection task that prevents an excessive increase in the temperature of the IGBT 31 (switch 3) due to its overtemperature while the IGBT 3 is driven in a selected one of prepared lock drive modes in which the IGBT 31 is locked in the on state for a certain amount of time. The prepared lock drive modes of the IGBT 31 in which the IGBT 31 is locked in the on state for a certain amount of time include, for example, a lock-on mode in which the ignition signal IGt is locked in the high level for a certain amount of time, and a high-rotation high-duty mode in which the ignition signal IGt has a relatively high duty so that the IGBT 31 is turned on with a relatively long on-duration every predetermined short period, so that the RPM of the engine 100 is relatively high.

That is, when detecting the IGBT 3 is in an overtemperature state in a selected one of the lock drive modes, the lock prevention circuit 5 is configured to output, to the driver 41, the overtemperature prevention signal S that causes the driver 41 to forcibly perform shutdown, i.e. thermal shutdown, of energization of the IGBT 31.

This prevents the IGBT 31 from being deteriorated, such as thermally damaged, due to its overtemperature.

Figure 3:
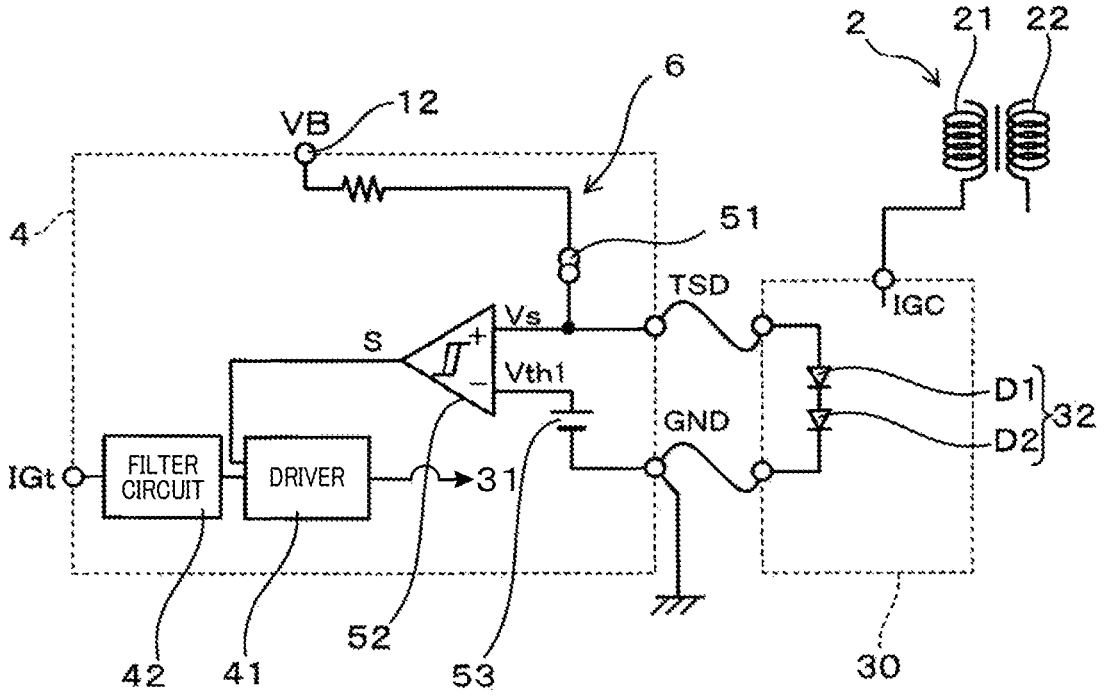
FIG. 3 is a circuit diagram schematically illustrating the selected components of the lock protection circuit of the ignition apparatus illustrated in FIG. 1.

Referring to FIGS. 2 and 3, the lock prevention circuit 5 includes, for example, a constant current source 51, an overtemperature detector 52, and a voltage source 53 with positive and negative terminals.

The overtemperature detector 52 is comprised of, for example, a hysteresis comparator, and has a non-inverting terminal (a positive terminal), an inverting input terminal (a negative terminal), and an output terminal.

The detection terminal TSD of the control circuit 4 and the non-inverting input terminal of the overtemperature detector 52 are connected to each other via a signal line SL. The constant current source 51 has an input terminal connected to the power terminal 12 of the control circuit 4, and an output terminal connected to both the detection terminal TSD of the control circuit 4 and the non-inverting input terminal of the overtemperature detector 52.

Note that FIG. 2 schematically illustrates selected components of the lock protection circuit 5 and selected components of the deterioration determination circuit 6 and their selected components; these components are used to perform energization control of the IGBT 31.

The non-inverting input terminal of the overtemperature detector 52 is connected to the detection terminal TSD of the control circuit 4, and the inverting input terminal of the overtemperature detector 52 is connected to the positive terminal of the voltage source 53. The negative terminal of the voltage source 53 is connected to the ground terminal GND of the ignition apparatus 1. The output terminal of the overtemperature detector 52 is connected to the driver 41.

The detection terminal TSD of the control circuit 4 is connected to the non-inverting input terminal of the overtemperature detector 52. As described above, the temperature sensor 32 outputs the detection voltage Vs as a parameter indicative of the temperature of the IGBT 32 across the detection terminal 32 and the ground terminal GND of the control circuit 4. This results in the detection voltage Vs being inputted to the non-inverting input terminal of the overtemperature detector 52.

The voltage source 53 is configured to apply, to the inverting input terminal of the overtemperature detector 52, a predetermined first threshold voltage Vth1; the predetermined first threshold voltage Vth1 corresponds to the predetermined energization prevention temperature T1. That is, when the temperature of the IGBT 31 has reached the energization prevention temperature T1, a value of the first threshold voltage Vth1 is detected by the temperature sensor 32 as the detection voltage Vs.

The constant current source 51 is connected between the non-inverting input terminal of the overtemperature detector 52 and the detection terminal TSD of the control circuit 4, and configured to apply, based on the drive voltage VB supplied from the unillustrated power source, a detection current to the first and second temperature-sensitive diodes D1 and D2 for detecting the temperature of the IGBT 31.

The overtemperature detector 52 of the lock prevention circuit 5 is configured to 1. Output the overtemperature prevention signal S to the driver 41 upon the detection voltage Vs inputted to the non-inverting input terminal of the overtemperature detector 52 being lower than the first threshold voltage Vth1

2. Disable output of the overtemperature prevention signal S to the driver 41 upon the detection voltage Vs inputted to the non-inverting input terminal of the overtemperature detector 52 being higher or equal to the first threshold voltage Vth1

While the overtemperature prevention signal S is disabled from being outputted from the overtemperature detector 52 to the driver 41, the lock prevention circuit 5 is operating in an energization permission mode. In contrast, while the overtemperature prevention signal S is outputted from the overtemperature detector 52 to the driver 41, the lock prevention circuit 5 is operating in an energization prevention mode.

Referring to FIG. 4, if the ignition signal IGt is locked in the high level for control of energization of the IGBT 31, the IGBT 31 is locked in the on state from time to, so that the temperature of the IGBT 31 rises with the energization time, i.e. the on duration, of the IGBT 31 to have reached the energization prevention temperature T1.

As described above, the higher the temperature of each of the first and second temperature-sensitive diodes D1 and D2, the lower the forward voltage across the corresponding one of the first and second temperature-sensitive diodes D1 and D2. For this reason, the detection voltage Vs inputted to the non-inverting input terminal of the overtemperature detector 52 is higher than the first threshold voltage Vth1 until the temperature of the IGBT 31 reaches the energization prevention temperature T1, so that the overtemperature prevention signal S is disabled from being outputted from the overtemperature detector 52 to the driver 41 during the energization permission mode of the lock prevention circuit 5. This enables the driver 41 and the switch 45 to output the drive voltage VB to the gate of the IGBT 31, thus turning on the IGBT 31 to thereby energize the ignition coil 2.

While the temperature of the IGBT 31 rises with the energization time, i.e. the on duration, of the IGBT 31, the detection voltage Vs decreases, and when the temperature of the IGBT 31 has reached the energization prevention temperature T1, a value of the detection voltage Vs becomes lower than the detection threshold voltage Vgth1 at the time t1.

In response to the value of the detection voltage Vs becoming lower than the detection threshold voltage Vgth1 at the time t1, the overtemperature detector 52 determines that the IGBT 31 is in an overtemperature condition, thus outputting the overtemperature prevention signal S to the driver 41, so that the operation mode of the lock prevention circuit 5 is switched from the energization permission mode to the energization prevention mode at the time t1.

In response to receiving the overtemperature prevention signal S, the driver 41 and the switch 45 shut down application of the drive voltage VB to the gate of the IGBT 31, thus turning off the IGBT 31. This results in shutdown of energization of the ignition coil 2 at the time t1.

Next, the following describes how the lock prevention circuit 5 works with reference to FIG. 4.

As illustrated in FIG. 4, at the time t1, energization of the IGBT 31 is shut down, so that the temperature of the IGBT 31 gradually decreases after the time t1 whereas the detection voltage Vs gradually increases after the time t1.

Previously determining the first threshold voltage Vth1 corresponding to the predetermined energization prevention temperature T1 enables overtemperature of the IGBT 31 to be detected based on comparison between the first threshold voltage Vth1 and the detection voltage Vs, making it possible to protect the IGBT 31 against overtemperature.

It is preferable to previously determine an energization permission temperature T2 that enables, after shutdown of energization of the IGBT 31 in response to the overtemperature detection signal S, energization of the IGBT 31 at time t2 if the temperature of the IGBT 31 has decreased down to a second threshold voltage Vth2 previously determined to correspond to the energization permission temperature T2.

That is, as described above, the overtemperature detector 52 of the first embodiment is configured to control energization of the IGBT 31 in accordance with predetermined hysteresis characteristics. That is, the overtemperature detector 52 of the first embodiment is configured to 1. Shut down energization of the IGBT 31 upon the detection voltage Vs being lower than the first threshold voltage Vth1
2. Hold the shutdown even if the detection voltage Vs being higher or equal to the first threshold voltage Vth1
3. Energize the IGBT 31 upon the detection voltage Vs being higher than the second threshold voltage Vth2 that is set to be higher than the first threshold voltage Vth1

Specifically, the lock prevention circuit 5 prevents energization of the IGBT 31 from the time t1 to the time t2 at which the temperature of the IGBT 31 has reached the energization permission temperature T2 even upon the ignition signal IGt with the high level being input to the lock prevention circuit 5. This results in the IGBT 31 being maintained in the off state.

Thereafter, the lock prevention circuit 5 cancels the output of the overtemperature detection signal S upon the temperature of the IGBT 31 exceeding the energization permission temperature T2 at the time t2, so that the operation mode of the lock prevention circuit 5 is switched from the energization prevention mode to the energization permission mode. After the time t2, the lock prevention circuit 5 energizes the IGBT 31 in response to input of the ignition signal IGt with the high level thereto to thereby turn on the IGBT 31 at time t3. After the time t3, the temperature of the IGBT 31 gradually increases due to the IGBT 31 being in the on state whereas the detection voltage Vs gradually decreases after the time t3.

As described above, the lock prevention circuit 5 is configured such that the overtemperature detection circuit 52 determines whether to output the overtemperature detection signal S to the driver 41 in accordance with the detection voltage Vs, the first threshold voltage Vth1, and the second threshold voltage Vth2. This configuration enables the temperature of the IGBT 31 to be adjusted within a predetermined temperature range.

As described above, the ignition coil 2 is configured to perform an ignition operation based on shutdown of energization of the primary coil 21. This configuration therefore may result in the occurrence of a spark discharge in the ignition plug P at an unscheduled timing due to forcible turn-off of the IGBT 31 by the above overtemperature protection task. Additionally, the rate of increase in the temperature of the IGBT 31 depends on how the IGBT 31 is mounted on the circuit board of the switching circuit 30. In particular, a decrease in the heat dissipation characteristics of the IGBT 31 may cause the IGBT 31 to be likely to increase.

For example, the IGBT 31 (switch 3) is configured to dissipate heat generated therefrom to the circuit board via the adhesive, such as the solder paste interposed between the IGBT 31 and the circuit board. A progression of deterioration of the adhesive, such as the solder pate, may cause cracks in the adhesive to increase, resulting in the heat dissipation of the IGBT 31 becoming deteriorated.

Such deterioration of the heat dissipation of the IGBT 31 may cause the temperature of the IGBT 31 to be likely to increase even if the IGBT 31 is operated normally. This may cause the lock prevention circuit 5 to operate to output the overtemperature detection signal S to the driver 41 although the ignition signal IGt is driven normally without being unlocked in the high level. This operation of the lock prevention circuit 5 may result in the ignition plug P being ignited earlier than properly scheduled, in other words, resulting in preignition of the ignition plug P. This preignition of the ignition plug P may result in damage to components constituting the engine 100.

From this viewpoint, the control circuit 4 includes the deterioration determination circuit 6 in addition to the lock prevention circuit 5.

The deterioration determination circuit 6 is configured to detect an increase in the temperature of the IGBT 31 due to the deterioration of the switching circuit 30 to thereby output the deterioration detection signal S1 to the filter circuit 63 before the lock protection circuit 5 outputs the overtemperature detection signal S based on the increase in the temperature of the IGBT 31 due to the deterioration of the switching circuit 30.

As described above, as illustrated in FIG. 2, the deterioration determination circuit 6 of the first embodiment includes the deterioration detection period generator 7, the switch SW1, the differential amplifier 61, the comparator 62, the filter circuit 63, the counter 64, the capacitor 65, and the voltage source 66.

The deterioration detection period generator 7 generates the deterioration detection period Ta in response to the input of the ignition signal IGt to the control circuit 4.

The differential amplifier 61 calculates, in response to the input of the ignition signal IGt to the control circuit 4, an initial value of the detection voltage Vs at the input of the ignition signal IGt; the initial value of the detection voltage Vs corresponds to the initial value of the temperature of the IGBT 31 at the input of the ignition signal IGt. The differential amplifier 61 additionally calculates, for each cycle, the temperature-parameter increase ΔVs relative to the initial value of the detection voltage Vs.

Specifically, the differential amplifier 61 has a pair of first and second differential input terminals and an output terminal.

A pair of signal lines L1 and L2 are branched from the signal line SL connecting between the detection terminal TSD of the control circuit 4 and the non-inverting input terminal of the overtemperature detector 52. The signal line L1 branched from the signal line SL is connected to the first differential input terminal of the differential amplifier 61, and the signal line L2 branched from the signal line SL is connected to the second differential input terminal of the differential amplifier 61. This enables the detection voltage Vs to be inputted to both the first and second differential input terminals of the differential amplifier 61.

The switch SW1 is provided on the signal line L1; the switch SW1 is configured to disconnect the first differential input terminal of the differential amplifier 61 from the detection terminal TSD when turned off.

The capacitor 65 is connected between a portion of the signal line L1 and the ground line Lg; the portion of the signal line L1 is located between the differential amplifier 61 and the switch SW1.

Referring to FIG. 5, the switch SW1 has an unillustrated control terminal to which the ignition signal IGt is inputted. This enables the switch SW1 to be alternately turned on, i.e. closed, upon the ignition signal IGt being in the low level, and turned off, i.e. opened, upon the ignition signal IGt being in the high level. The on state of the switch SW1 enables the first differential input terminal of the differential amplifier 61 and the detection terminal TSD to be connected to each other, enabling the detection voltage Vs to be inputted to the first differential input terminal of the differential amplifier 61. The on state of the switch SW1 additionally enables the capacitor 65 to be charged based on the detection voltage Vs via the signal line L1, so that a voltage A1 across the capacitor 65, which will be referred to as a capacitor voltage A1, becomes equivalent to the detection voltage Vs inputted to the signal line L1.

Figures 5A, 5B:
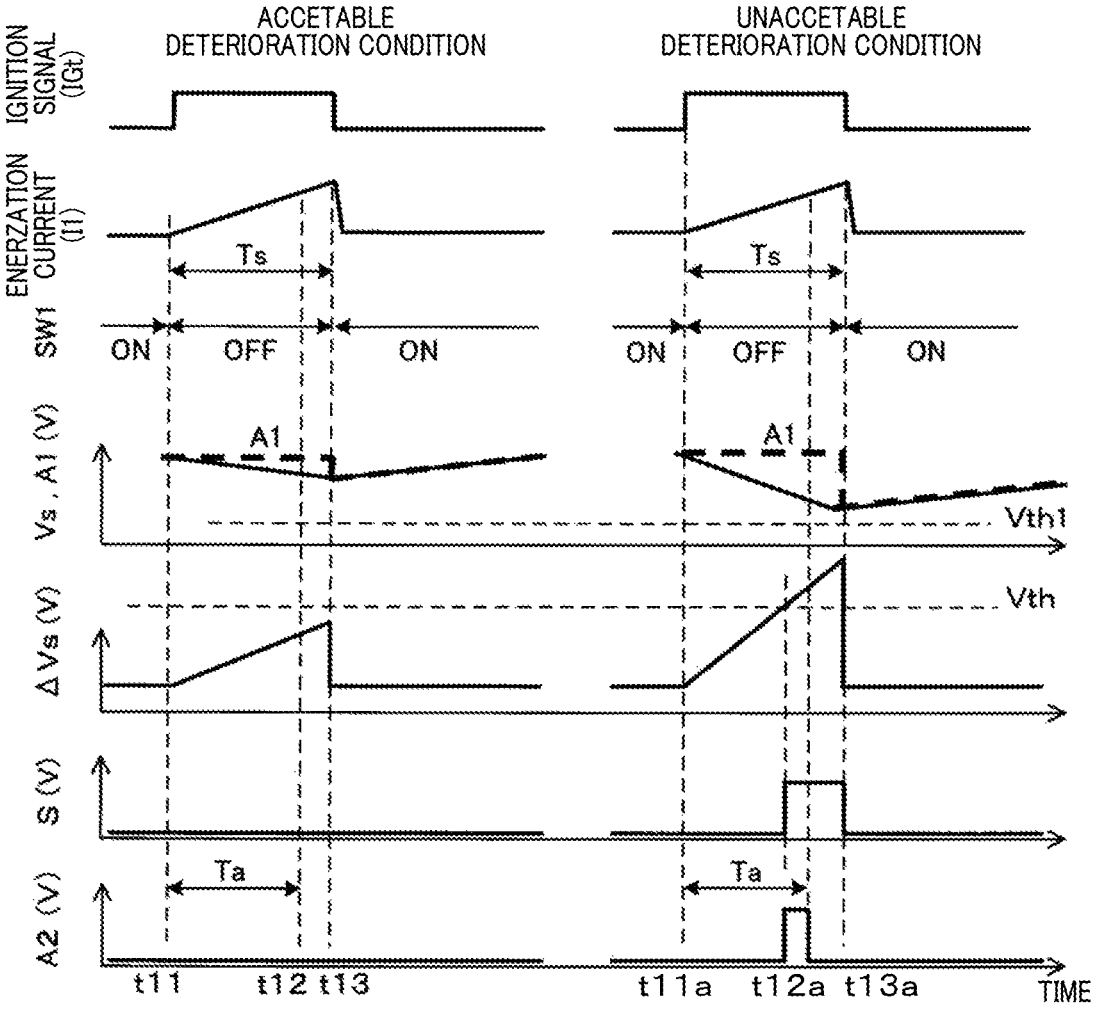
FIG. 5A is a joint timing chart schematically illustrating an example of how the deterioration determination circuit works in an acceptable deterioration condition.
FIG. 5B is a joint timing chart schematically illustrating an example of how the deterioration determination circuit works in an unacceptable deterioration condition.
Figure 6:
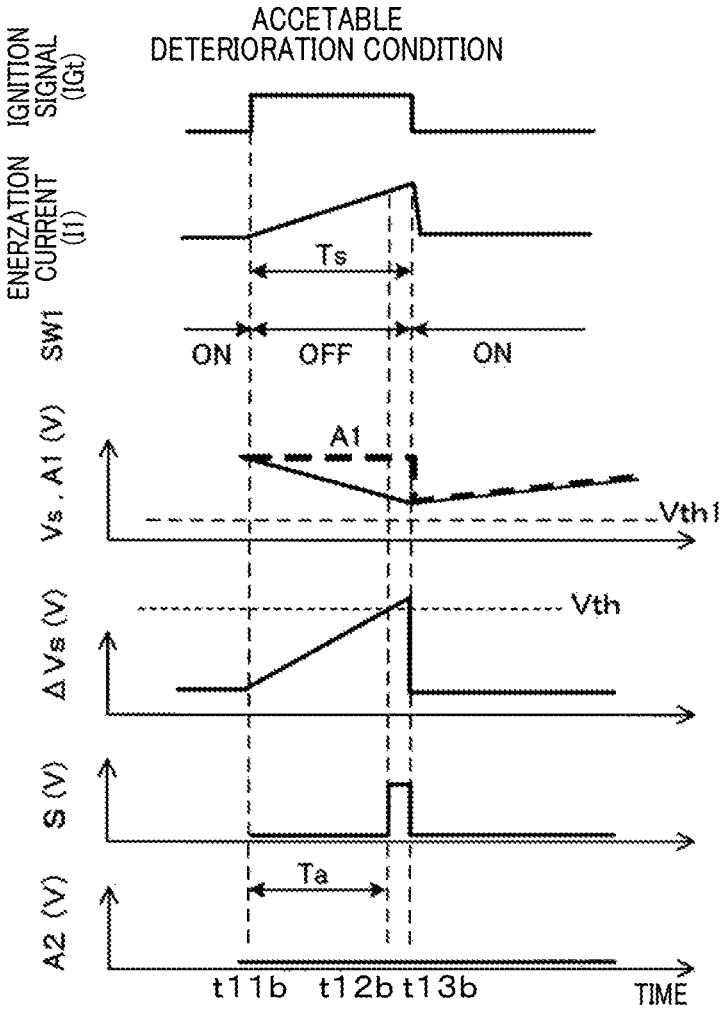
FIG. 6 is a joint timing chart schematically illustrating another example of how the deterioration determination circuit works in the acceptable deterioration condition.

Next, the following describes how the deterioration determination circuit 6 works with a level of the deterioration of the switching circuit 30 being within an acceptable level, i.e., an acceptable range, which represents an acceptable deterioration condition, with reference to FIG. 5A.

Before time t11 illustrated in FIG. 5A, the ignition signal IGt is in the low level, so that the capacitor voltage A1 across the capacitor 65 is equivalent to the detection voltage Vs inputted to the second differential input terminal of the differential amplifier 61 from the signal line L2. This results in a constant value of the temperature-parameter increase ΔVs being outputted from the differential amplifier 61 based on a differential value between the detection voltage Vs at the first differential input terminal and the detection voltage Vs at the second differential input terminal.

When the ignition signal IGt is inputted to the control circuit 4 at the time t11, the switch SW1 is turned off, so that the capacitor voltage A1 is maintained as a value of the detection voltage Vs at the time t11.

Because the switch SW1 is in the off state, the capacitor voltage A1 inputted to the first differential input terminal of the differential amplifier 41 is fixed to the value of the detection voltage Vs at the input of the ignition signal IGt to the control circuit 4 at the time t11; the value of the detection voltage Vs is referred to as the reference voltage set forth above.

The turn-on of the IGBT 31 in response to the input of the ignition signal IGt to the control circuit 4 causes the detection voltage Vs to gradually decreases after the time t11. The turn-on of the IGBT 31 causes an energization current I1 flowing through the primary winding 21 of the ignition coil 2 to increase, resulting in the temperature of the IGBT 31 increasing with the increase of the energization current I1 after the time t11. However, because the level of the deterioration of the switching circuit 30 being within the acceptable level so that the rate of decrease in the detection voltage Vs is small, an absolute value of the voltage difference between the capacitor voltage A1 and the detection voltage Vs is relatively small.

Next, the following describes how the deterioration determination circuit 6 works with the level of the deterioration of the switching circuit 30 being higher than the acceptable level, which represents an unacceptable deterioration condition, with reference to FIG. 5B.

Before time t11*a* illustrated in FIG. 5B, the ignition signal IGt is in the low level, so that the capacitor voltage A1 across the capacitor 65 is equivalent to the detection voltage Vs inputted to the second differential input terminal of the differential amplifier 61 from the signal line L2. This results in the constant value of the temperature-parameter increase ΔVs being outputted from the differential amplifier 61 based on the differential value between the detection voltage Vs at the first differential input terminal and the detection voltage Vs at the second differential input terminal.

When the ignition signal IGt is inputted to the control circuit 4 at the time t11*a*, the switch SW1 is turned off, so that the capacitor voltage A1 is maintained as a value of the detection voltage Vs at the time t11*a*.

Because the switch SW1 is in the off state, the capacitor voltage A1 inputted to the first differential input terminal of the differential amplifier 41 is fixed to the initial value of the detection voltage Vs at the input of the ignition signal IGt to the control circuit 4 at the time t11*a*.

Due to the level of the deterioration of the switching circuit 30 being higher than the acceptable level, the turn-on of the IGBT 31 in response to the input of the ignition signal IGt to the control circuit 4 causes the detection voltage Vs in the unacceptable deterioration condition to decrease after the time t11*a* in a shorter time than the detection voltage Vs in the acceptable deterioration condition. This results in the absolute value of the voltage difference between the capacitor voltage A1 and the detection voltage Vs becomes larger as that in the acceptable deterioration condition.

The deterioration determination circuit 6 is designed to perform determination of whether the deterioration of the switching circuit 30 is within the acceptable level using the difference between (i) Change of the detection voltage Vs in the acceptable deterioration condition (ii) Change of the detection voltage Vs in the unacceptable deterioration condition Specifically, the deterioration determination circuit 6 calculates, for each cycle, the temperature-parameter increase ΔVs relative to the initial value of the detection voltage Vs during the deterioration detection period Ta. Then, the deterioration determination circuit 6 compares the temperature-parameter increase ΔVs calculated for each cycle with the deterioration detection threshold Vth previously determined for the switching circuit 30 to accordingly determine, based on the comparison result for each cycle, whether the level of the deterioration of the switching circuit 30 is higher than the acceptable level.

The deterioration detection period Ta is a period with a predetermined length; the period has been started since the input of the ignition signal IGt to the control circuit 4. The differential amplifier 61 is configured to amplify an absolute of the differential value between the capacitor voltage A1 at the first differential input terminal and the detection voltage Vs at the second differential input terminal, thus outputting the amplified absolute of the differential value as the temperature-parameter increase ΔVs.

The comparator 62 has a non-inverting terminal (a positive terminal), an inverting input terminal (a negative terminal), and an output terminal. The non-inverting terminal of the comparator 62 is connected to the output terminal of the differential amplifier 61, and the inverting terminal of the comparator 62 is connected to the positive terminal of the voltage source 66. The negative terminal of the voltage source 66 is connected to the ground terminal GND of the ignition apparatus 1. The output terminal of the comparator 62 is connected to the filter circuit 63.

As described above, the differential amplifier 61 outputs the temperature-parameter increase ΔVs from the output terminal thereof, so that the temperature-parameter increase ΔVs is inputted to the non-inverting input terminal of the comparator 62.

The voltage source 66 is configured to apply, to the inverting input terminal of the comparator 62, a predetermined deterioration detection threshold Vth.

The comparator 62 is configured to

1. Disable output of the deterioration detection signal S1 to the filter circuit 63 upon the temperature-parameter increase ΔVs inputted to the non-inverting input terminal of the comparator 62 being lower than or equal to the deterioration detection threshold Vth 2. Output the deterioration detection signal S1 to the filter circuit 63 upon the temperature-parameter increase ΔVs inputted to the non-inverting input terminal of the comparator 62 being higher than the deterioration detection threshold Vth The deterioration determination circuit 6 is configured such that, in the acceptable deterioration condition, the temperature-parameter increase ΔV has not reached the deterioration detection threshold Vth, resulting in no output of the deterioration detection signal S1 from the comparator 62 (see FIG. 5).

The deterioration detection signal S1 outputted from the comparator 62 is inputted to the counter 64 through the filter circuit 63.

The filter circuit 63 is configured to

1. Receive the signal representing the deterioration detection period Ta being outputted from the deterioration detection period generator 7 to the control circuit 4

2. Enable the deterioration detection signal S1 to be passed therethrough to the counter 64 upon the signal representing the deterioration detection period Ta being inputted to the control circuit 4

For example, the deterioration detection period generator 7 is comprised of a timer circuit. The deterioration detection period generator 7 generates the deterioration detection period Ta in response to the input of the ignition signal IGt to the filter circuit 63, and outputs the deterioration detection period Ta to the filter circuit 63.

The deterioration detection period Ta is preferably set to be shorter than a predetermined normal input period Ts of the ignition signal IGt to the control circuit 4. As illustrated in FIG. 5B, in the unacceptable deterioration condition, the heat dissipation characteristics of the IGBT 31 decrease so that the rate of increase in the temperature of the IGBT 31 is sharper than that in the acceptable deterioration condition. We therefore experimentally measured the rate of increase in the temperature of the IGBT 31 in the acceptable deterioration condition. The deterioration detection period Ta is therefore preferably set, based on the measured rate of increase in the temperature of the IGBT 31, to an appropriate value such that the deterioration detection signal S1 is outputted before the temperature of the IGBT 31 (switch 3) reaches the energization prevention temperature T1 in the unacceptable deterioration condition.

In other words, the deterioration detection period Ta and the overtemperature detection threshold Vth1 are preferably set, based on the measured rate of increase in the temperature of the IGBT 31, to appropriate values such that the deterioration detection signal S1 is outputted before the detection voltage Vs reaches the overtemperature detection threshold Vth1 in the unacceptable deterioration condition.

Comparing the temperature-parameter increase ΔV with the deterioration detection threshold Vth enables the deterioration determination circuit 6 to promptly determine whether the level of the deterioration of the switching circuit 30 is higher than the acceptable level before the lock prevention circuit 5 operates to output the overtemperature detection signal S to the driver 41.

The filter circuit 63 is configured to output, to the counter 64, an output signal A2 with a low level upon no deterioration detection signal S1 being inputted thereto, and switch the low level of the signal A2 to the high level upon the deterioration detection signal S1 being inputted thereto while the signal indicative of the deterioration detection period Ta is inputted thereto. That is, the filter circuit 63 is configured to maintain, even if the deterioration detection signal S1 is inputted thereto, the low level of the output signal A2 upon no signal indicative of the deterioration detection period Ta being inputted thereto, that is, upon the deterioration detection period Ta being terminated.

The deterioration of the switching circuit 30 gradually proceeds over time, so that the detection voltage Vs is likely to decrease due to the deterioration of the heat dissipation characteristics of the IGBT 31. This may result in, as illustrated in FIG. 6, an arrival of the temperature-parameter increase ΔV at the deterioration detection threshold Vth at time t13*b* after the termination of the deterioration detection period Ta at time t12*b* in the acceptable deterioration condition.

Even if the temperature-parameter increase ΔV has arrived at the deterioration detection threshold Vth, because of the termination of the deterioration detection period Ta, the filter circuit 63 maintains the low level of the output signal A2 even if the deterioration detection signal S1 is inputted thereto, the low level of the output signal A2 upon no signal indicative of the deterioration detection period Ta being inputted thereto, that is, upon the deterioration detection period Ta being terminated.

The counter 64 is configured to count the number of switching of the output signal A2 from the low level to the high level, and store the counted number therein. The counter 64 has an output terminal connected to the driver 41, and sends, to the driver 41, a count signal indicative of the number of switching of the output signal A2 from the low level to the high level.

This enables the driver 41 to limit energization of the IGBT 31 in response to receiving the count signal.

For example, the driver 41 can turn off the IGBT 31 in response to receiving the count signal.

As described above, the control circuit 4 is configured to, in response to, for example, the input of the ignition signal IGt to the control circuit 4, perform 1. A first determination of whether the IGBT 31 is in the overtemperature condition using the overtemperature detection circuit 52 to thereby output, to the driver 41, the overtemperature detection signal S upon the first determination being affirmative, i.e., the IGBT 31 being determined to be in the overtemperature condition 2. A second determination of whether the level of the deterioration of the switching circuit 30 is higher than the acceptable level using the deterioration determination circuit 6 to thereby output, to the driver 41, the deterioration detection signal S1 upon determination that, before the first determination being affirmative, the level of the deterioration of the switching circuit 30 is higher than the acceptable level This configuration therefore makes it possible to output, to the driver 41, the deterioration detection signal S1 upon determination that the level of the deterioration of the switching circuit 30 is higher than the acceptable level before outputting of the overtemperature detection signal S to the driver 41. This configuration prevents unexpected execution of the overtemperature protection task.

The deterioration determination circuit 6 of the first embodiment can have

1. A first function of sending the deterioration detection signal S1 to an external ECU located outside the ignition apparatus 1 for instructing the external ECU to determine whether the level of the deterioration of the switching circuit 30 is higher than the acceptable level, and/or 2. A second function of storing, in a storage previously installed therein, information indicative of the outputting of the deterioration detection signal S1 to the driver 41

If the deterioration determination circuit 6 includes the first function, the counter 64 can be eliminated from the deterioration determination circuit 6.

The filter circuit 63 can be configured to output, to the driver 41, the deterioration detection signal S1, thus causing the driver 41 to turn off the IGBT 31. This enables the counter 64 to be eliminated from the deterioration determination circuit 6.

The counter 64 can be configured to output, to the driver 41, a definitive deterioration signal S2 with a high level upon the counted number having reached a predetermined threshold number, and thereafter the counter 64 resets the counted number.

This preferably causes the driver 41 to continuously energize the IGBT 31 in response to receiving the definitive deterioration signal S2 for a current ignition signal IGt currently inputted to the control circuit 4, and to prevent energization of the IGBT 31 for the following ignition signals IGt after the current ignition signal IGt.

Second Embodiment

The following describes the second embodiment of the present disclosure. The structures and/or functions of an ignition apparatus 1A according to the second embodiment are different from those of the ignition apparatus 1 according to the first embodiment in the following points. The following therefore mainly describes the different points.

The ignition apparatus 1A includes a deterioration determination circuit 6A comprised of a deterioration detection period generator 7A.

Figure 7A:
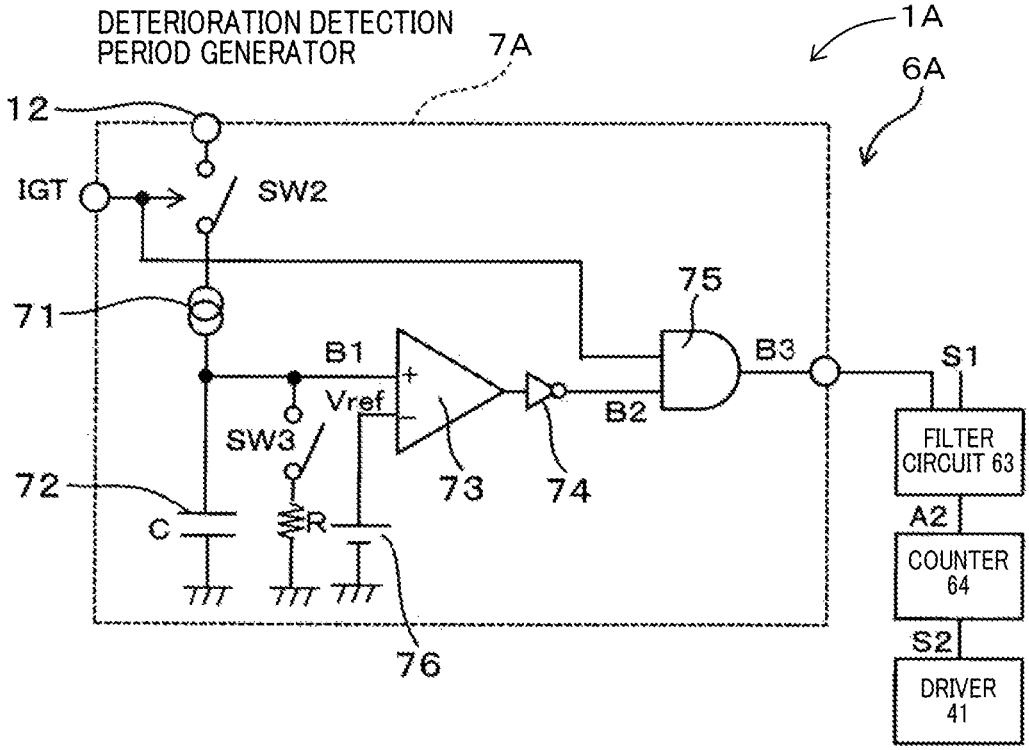
FIG. 7A is a circuit diagram illustrating selected components of a deterioration detection period generator of a deterioration determination circuit according to the second embodiment of the present disclosure.

As illustrated in FIG. 7A, the deterioration detection period generator 7A of th deterioration determination circuit 6A triggers generation of a timer signal B3 in response to the input of the ignition signal IGt to the control circuit 4; the timer signal B3 is, for example, a pulse signal having a high-level width, i.e. pulse width that represents the deterioration determination period Ta. The deterioration detection period generator 7A outputs the timer signal B3 to the filter circuit 63, so that both the deterioration detection signal S1 and the timer signal B3 are inputted to the filter circuit 63.

Like the first embodiment, the output signal A2 of the filter circuit 63 is inputted to the counter 64.

The counter 64 is configured to (i) Count the number of times the output signal A2 is switched from the low level to the high level (ii) Store the counted number therein (iii) Output, to the driver 41, the definitive deterioration signal S2 upon the counted number having reached a predetermined threshold number (iv) Reset the counted number upon the counted number having reached a predetermined threshold number The deterioration detection period generator 7A of the second embodiment is designed as, for example, an analog circuit.

Specifically, as illustrated in FIG. 7A, the deterioration detection period generator 7A designed as an analog circuit includes a constant current source 71, a capacitor 72, a comparator 73, an inverter 74, an AND gate 75, a voltage source 76 with positive and negative terminals, a resistor R, and switches SW2 and SW3.

The capacitor 72 has opposing first and second electrodes.

The constant current source 71 has an input terminal connected to the power terminal 12 via the switch SW2, and an output terminal connected to the ground line GND of the ignition apparatus 1A via the first electrode of the capacitor 72. The second electrode of the capacitor 72 is connected to the ground line GND of the ignition apparatus 1A.

The comparator 73 has a non-inverting terminal (a positive terminal), an inverting input terminal (a negative terminal), and an output terminal. The non-inverting terminal of the comparator 73 is connected to the connection point between the output terminal of the constant current source 71 and the capacitor C. The inverting input terminal of the comparator 73 is connected to the positive terminal of the voltage source 76, and the negative terminal of the voltage source 76 is connected to the ground terminal GND of the ignition apparatus 1A.

The inverter 74 has an input terminal and an output terminal. The AND gate 75 has first and second input terminals and an output terminal. The output terminal of the comparator 73 is connected to the input terminal of the inverter 74, and the output terminal of the inverter 74 is connected to the first input terminal of the AND gate 75. To the second input gate of the AND gate 75, the ignition signal IGt is inputted. The output terminal of the comparator 75 is connected to the filter circuit 63.

A series circuit comprised of the switch SW3 and the resistor R, which are connected in series to each other, is connected between the non-inverting input terminal of the comparator 73 and the ground terminal GND of the ignition apparatus 1A to be parallel to the capacitor 72.

The switch SW2 has an unillustrated control terminal to which the ignition signal IGt is inputted. This enables the switch SW2 to be alternately turned on, i.e. closed, upon the ignition signal IGt being in the high level, and turned off, i.e. opened, upon the ignition signal IGt being in the low level. The on state of the switch SW2 enables the constant current source 71 to supply, based on the drive voltage VB, a constant current to the capacitor 72 and the non-inverting input terminal of the comparator 73, thus storing electrical charge in the capacitor 72.

A voltage B1 based on the electrical charge stored in the capacitor 72 is applied to the non-inverting input terminal of the comparator 73.

Additionally, the voltage source 76 is configured to apply, to the inverting input terminal of the comparator 73, a predetermined reference voltage Vref.

Figure 7B:
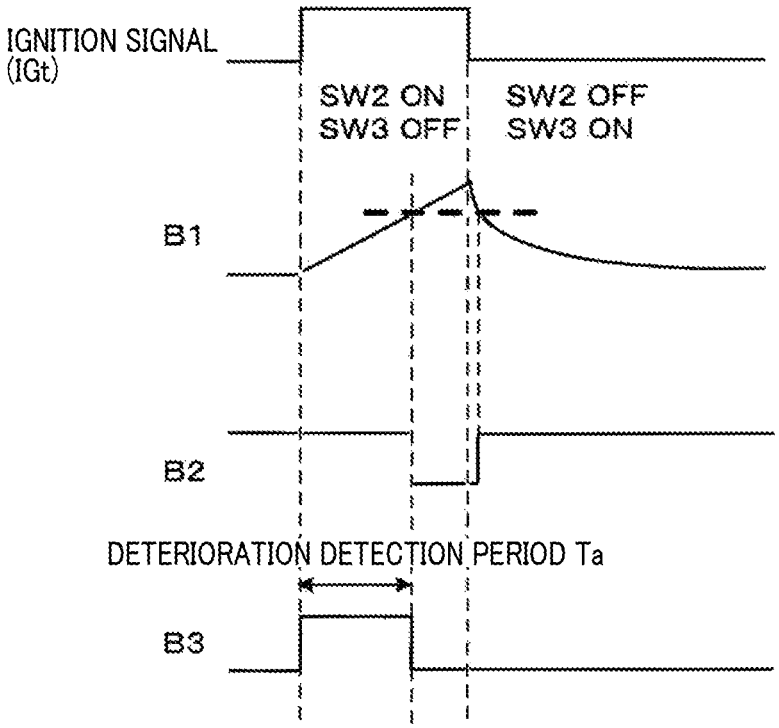
FIG. 7B is a joint timing chart schematically illustrating an example of how the deterioration detection period generator works according to the second embodiment.

As illustrated in FIG. 7B, the above configuration of the deterioration detection period generator 7A causes the voltage B1 based on the electrical charge stored in the capacitor 72, which is inputted to the non-inverting input terminal of the comparator 73, to gradually increase with a predetermined time constant of the capacitor 72 with the input of the ignition signal IGt to the deterioration detection period generator 7A.

Until the input voltage B1 reaches the reference voltage Vref, the reference voltage Vref is higher than the input voltage B1, so that the comparator 73 outputs a low-level signal to the inverter 74, so that a signal B2 with the high level outputted from the inverter 74 is inputted to the first input terminal of the AND circuit 75. That is, until the input voltage B1 reaches the reference voltage Vref, the signal B2 with the high level is inputted to the first input terminal of the AND circuit 75.

To the second input terminal of the AND circuit 75, the ignition signal IGt is directly inputted. This results in an output signal of the AND circuit 75 being switched from a low-level signal to a high-level signal at the time when the ignition signal IGt is inputted to the second input terminal of the AND circuit 75.

The output signal with the high level is outputted from the AND circuit 75 to the filter circuit 63 as the timer signal B3. The switching of the timer signal B3 from the low level to the high level starts the deterioration detection period Ta (see FIG. 7B).

The reference voltage Vref inputted to the inverting input terminal of the comparator 73 is set to correspond to the length of the deterioration detection period Ta. That is, the length of the deterioration detection period Ta is set to a period for which the input voltage B1 has increased since the input of the ignition signal IGt to the deterioration detection period generator 7A until the input voltage B1 has exceeded the reference voltage Vref.

An increase in the input voltage B1 over the reference voltage Vref results in the high level of the signal B2 inputted to the first input terminal of the AND gate 75 being switched to the low level, so that the high-level timer signal B3 from the AND gate 75 is switched to the low-level timer signal B3. The switching of the high-level timer signal B3 to the low-level timer signal B3 results in the deterioration detection period Ta being terminated (see FIG. 7B).

That is, the deterioration detection period generator 7A is configured to continuously output the high-level timer signal B3 to the filter circuit 63 during the deterioration detection period Ta.

As described above, the series circuit comprised of the switch SW3 and the resistor R, which are connected in series to each other, is connected between the non-inverting input terminal of the comparator 73 and the ground terminal GND of the ignition apparatus 1A to be parallel to the capacitor 72.

For example, the switch SW3 has an unillustrated control terminal to which an inversion of the ignition signal IGt is inputted. This enables the switch SW2 and the switch SW3 to be complementarily switched. Specifically, the switch SW2 is turned on when the switch SW3 is turned off, and vice versa.

Turning on the switch SW3 immediately from turn-off of the switch SW2 makes it possible to connect the capacitor 72 to the ground terminal GND of the ignition circuit 1A, thus discharging the electrical charge stored in the capacitor 72 immediately.

The counter 64 of the second embodiment is configured to

Figure 8:
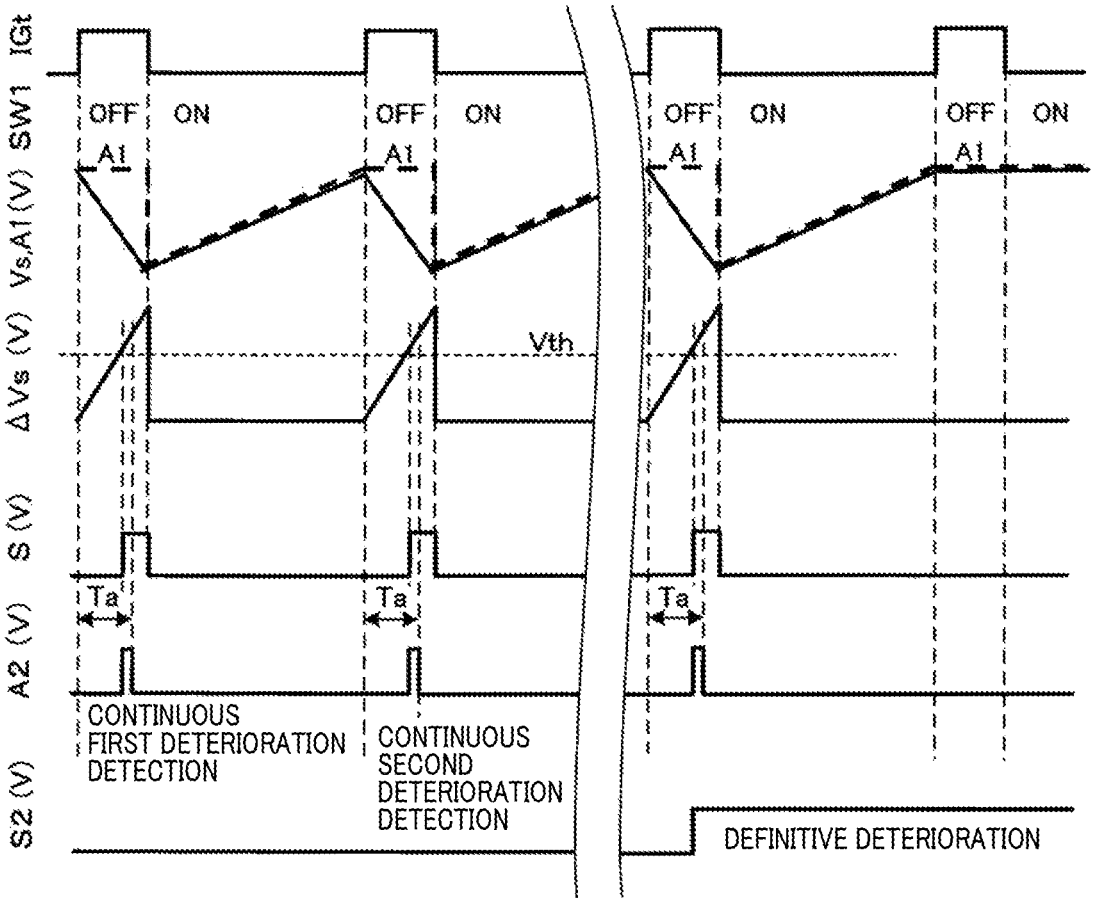
FIG. 8 is a joint timing chart schematically illustrating an example of how the deterioration determination circuit works in the unacceptable deterioration condition according to the second embodiment.

1. Count the number of times the deterioration detection signal S1 is inputted thereto
2. Store the counted number therein
3. Output, to the driver 41, the definitive deterioration signal S2 upon the counted number having reached a predetermined threshold number, and thereafter the counter 64 resets the counted number (see FIG. 8)

As described above, the high-level timer signal B3 is outputted to the filter circuit 63 from the deterioration detection period generator 7A in response to the input of the ignition signal IGt thereto. While the high-level timer signal B3 is outputted to the filter circuit 63 from the deterioration detection period generator 7A, when the temperature-parameter increase ΔV becomes higher than the deterioration detection threshold Vth, the deterioration detection signal S1 is outputted from the comparator 62 to the filter circuit 63. This enables the filter circuit 63 to increment, by one, a count value, whose initial value of zero, in response to detection of the deterioration detection signal S1.

Similarly, the filter circuit 63 increments, by one, the count value each time the deterioration detection signal S1 is inputted thereto from the comparator 62.

That is, the comparator 62 of the deterioration detection period generator 7A of the second embodiment is configured to repeatedly perform a task of determining whether the level of the deterioration of the switching circuit 30 is higher than the acceptable level each time the ignition signal IGt is inputted thereto, and repeatedly output the deterioration detection signal S1 to the counter 64 each time it is determined that the level of the deterioration of the switching circuit 30 is higher than the acceptable level.

The counter 64 is therefore configured to count the number of continuous deterioration detection signals S1 input thereto as a continuous detection number in response to inputting continuous ignition signals IGt to the deterioration detection period generator 7A. Then, the counter 64 is configured to determine that the level of the deterioration of the switching circuit 30 is higher than the acceptable level to accordingly determine that there is an unacceptable level of deterioration in the switching circuit 30 upon the continuous detection number having reached the predetermined threshold number, such as five times, and output, to the driver 41, the definitive deterioration signal S2.

This configuration makes it possible to improve the accuracy of determining whether there is an unacceptable level of deterioration in the switching circuit 30. This therefore enables proper energization of the IGBT 31 in accordance with how the deterioration of the switching circuit 30 proceeds while preventing erroneous determination that there is an unacceptable level of deterioration in the switching circuit 30.

Note that the counter 64 can be configured to count the number of times the discontinuous deterioration detection signals S1 are inputted thereto as a discontinuous detection number in response to inputting discontinuous ignition signals IGt to the deterioration detection period generator 7A. Then, the counter 64 is configured to determine that the level of the deterioration of the switching circuit 30 is higher than the acceptable level to accordingly determine that there is an unacceptable level of deterioration in the switching circuit 30 upon the discontinuous detection number having reached the predetermined threshold number, and output, to the driver 41, the definitive deterioration signal S2. The threshold number can be freely determined. The counter 64 can be designed as an analog counter or a digital counter.

Third Embodiment

The following describes the third embodiment of the present disclosure. The structures and/or functions of an ignition apparatus 1B according to the third embodiment are different from those of the ignition apparatus 1A according to the second embodiment in the following points. The following therefore mainly describes the different points.

Figure 9A:
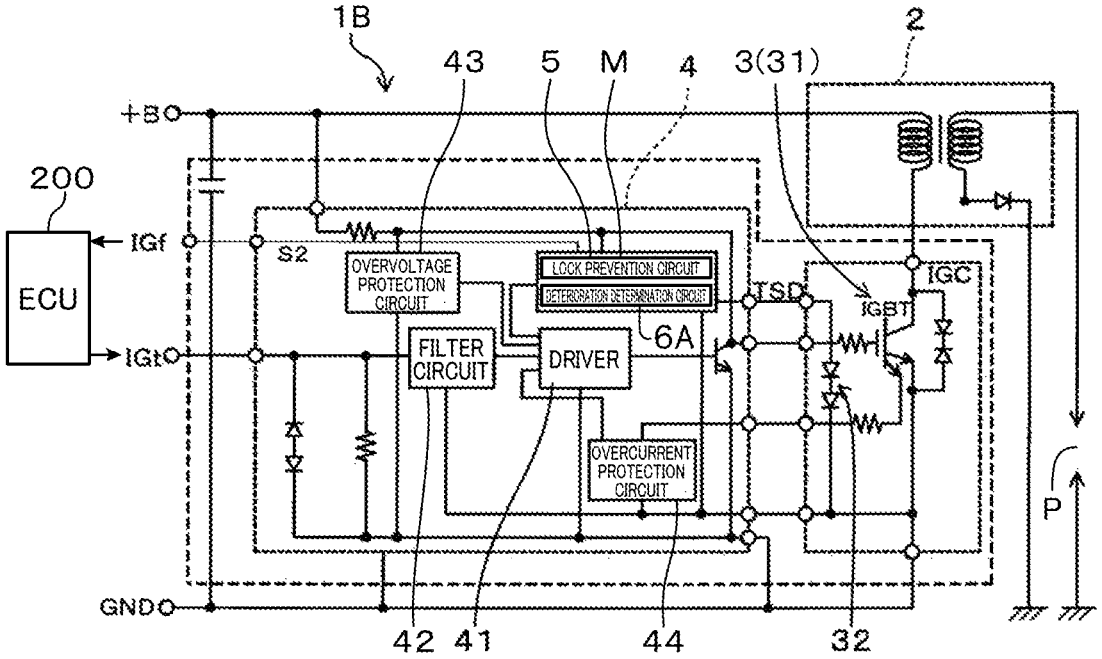
FIG. 9A is a circuit diagram illustrating an example of the configuration of an ignition apparatus according to the third embodiment of the present disclosure.

As illustrated in FIG. 9A, a control circuit 4B of the ignition apparatus 1B has an external input terminal T to which the lock prevention circuit 5 and the deterioration determination circuit 6 of the switch control circuit module M are connected; the lock prevention circuit 5 and the deterioration determination circuit 6 are connected to the driver 41 like the first embodiment. The external input terminal T of the control circuit 4B is connected to an external ECU, such as the ECU 200, so that the deterioration determination circuit 6 is capable of outputting, to the ECU 200, a deterioration information signal IGf based on the definitive deterioration signal S2.

Figure 9B:
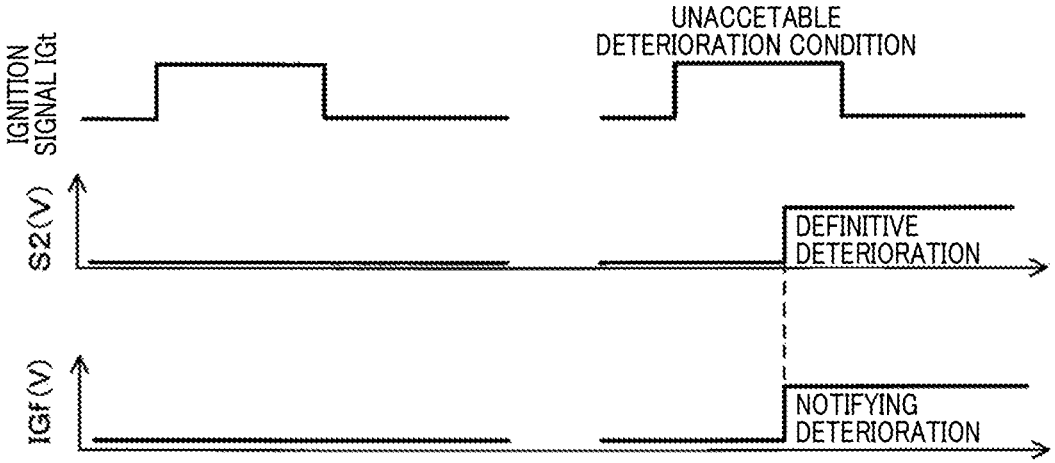
FIG. 9B is a joint timing chart schematically illustrating an example of how a deterioration determination circuit of the third embodiment works.

As illustrated in FIG. 9B, the deterioration information signal IGf is designed as a binary signal with one of the high level and low level, and the deterioration determination circuit 6 outputs, to the ECU 200, the deterioration information signal IGf with the high level in synchronization with the definitive deterioration signal S2 with the high level being outputted from the counter 64 to the driver 41 based on a present cycle of the ignition signal IGt that is outputted from the ECU 200 to the control circuit 4 (see FIG. 2).

In response to receiving the deterioration information signal IGf from the deterioration determination circuit 6, the ECU 200 is configured to stop a next cycle of outputting the ignition signal IGt to the ignition apparatus 1B, and perform a known task of reducing an increase in the temperature of the switching circuit 30 due to its deterioration.

The above configuration of the ignition apparatus 1B, which outputs the deterioration information signal IGf to the ECU 200 in synchronization with the definitive deterioration signal S2, makes it possible to reduce the occurrence of a spark discharge in the ignition plug P at an unscheduled timing.

For example, the ECU 200 is capable of turning on one or more warning lamps mounted to the vehicle in response to receiving the deterioration information signal IGf, thus notifying the deterioration of the switching circuit 30 to one or more occupants of the vehicle. The one or more warning lamps can be directly connected to the external input terminal T, so that each of the one or more warning lamps is turned on in response to receiving the deterioration information signal IGf.

Figure 10A:
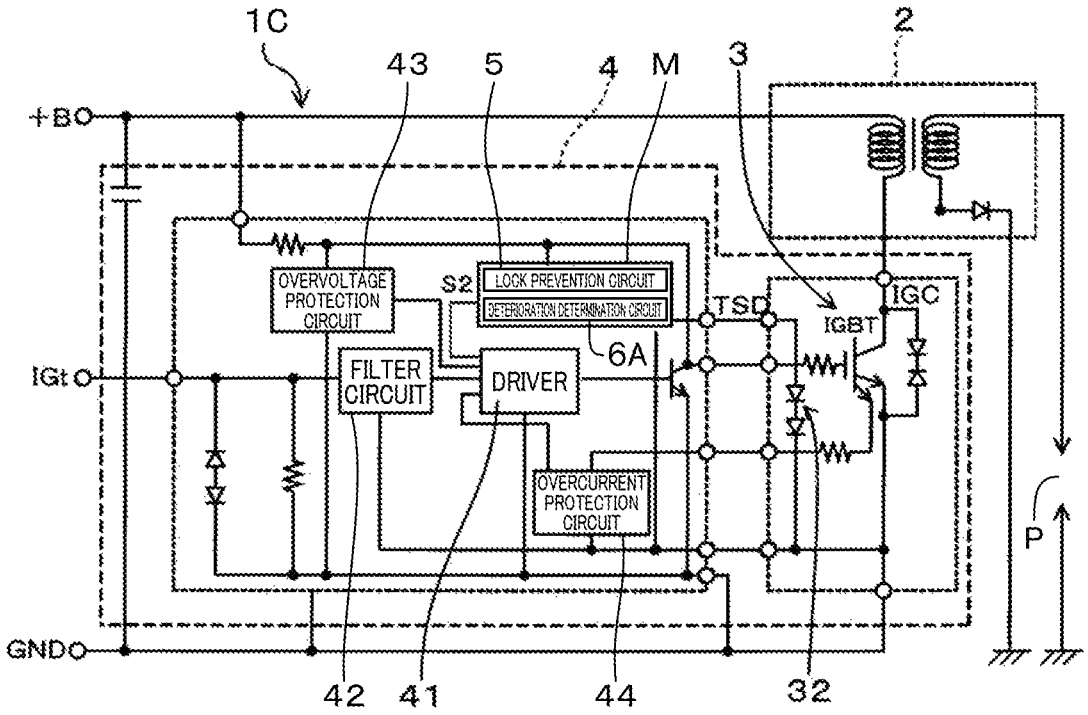
FIG. 10A is a circuit diagram illustrating an example of the configuration of an ignition apparatus according to a first modification of the second embodiment of the present disclosure.
Figure 10B:
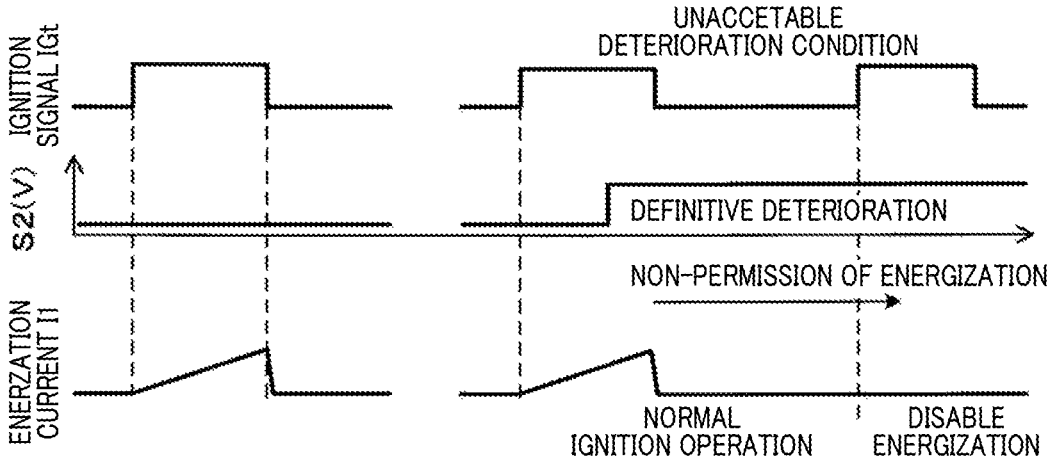
FIG. 10B is a joint timing chart schematically illustrating an example of how a deterioration determination circuit of the ignition apparatus according to the first modification works.

FIG. 10A schematically illustrates an ignition apparatus 1C according to a first modification of the second embodiment. When generating the definitive deterioration signal S2 at a present cycle of the ignition signal IGt that is outputted from the ECU 200 to the control circuit 4, the deterioration determination circuit 6A is configured not to output the definitive deterioration signal S2 to the driver 41 during the energization operation of the IGBT 31 based on the present cycle of the ignition signal IGt, and output the definitive deterioration signal S2 to the driver 41 after termination of the energization operation of the IGBT 31 based on the present cycle of the ignition signal IGt (see FIG. 10B).

This configuration of the ignition apparatus 1C enables the energization current I1 based on the present cycle of the ignition signal IGt to flow through the primary winding 21 of the ignition coil 2 until a spark discharge is generated in the ignition plug P, making it possible to prevent the occurrence of a spark discharge in the ignition plug P at an unscheduled timing.

This configuration of the ignition apparatus 1C prevents energization of the IGBT 31 based on each of the subsequent cycles of the ignition signal IGt, thus preventing the energization current It from flowing through the primary winding 21.

The above configuration of the ignition apparatus 1C reduces an increase in the temperature of the IGBT 31 due to the deterioration of the switching circuit 30 while reducing an impact on the ignition operation of the ignition plug P due to execution of the deterioration determination task set forth above.

Figure 11A:
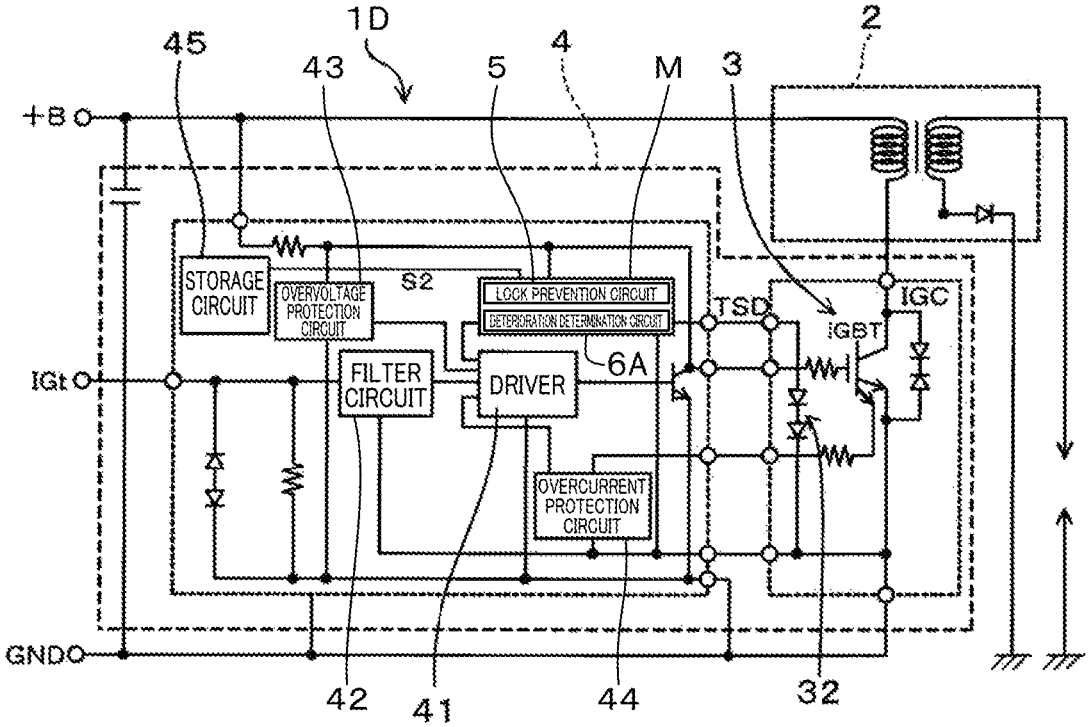
FIG. 11A is a circuit diagram illustrating an example of the configuration of an ignition apparatus according to a second modification of the second embodiment of the present disclosure.
Figure 11B:
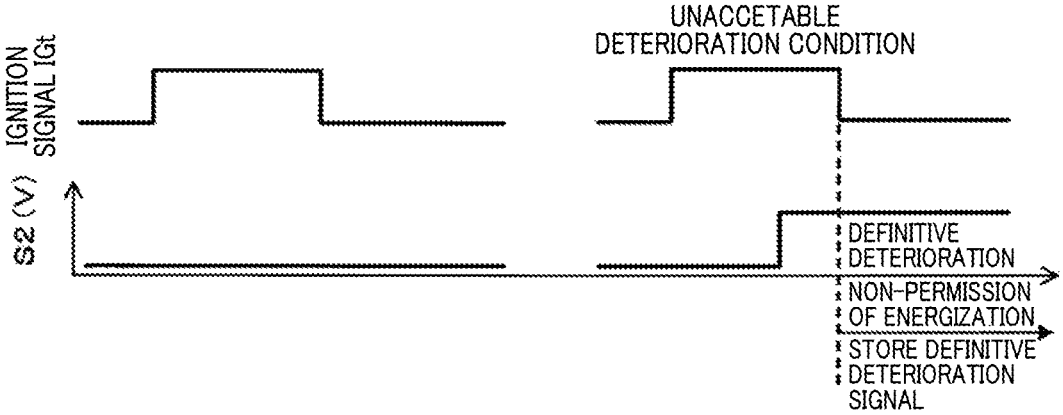
FIG. 11B is a joint timing chart schematically illustrating an example of how a deterioration determination circuit of the ignition apparatus according to the second modification works.

FIG. 11A schematically illustrates an ignition apparatus 1D according to a second modification of the second embodiment. In place of having the external input terminal T, a control circuit 4D of the ignition apparatus 1D includes a storage circuit 50. When generating the definitive deterioration signal S2 at a present cycle of the ignition signal IGt, a deterioration determination circuit 6D of the ignition apparatus 1D is configured to output the definitive deterioration signal S2 to the storage circuit 50 while outputting the definitive deterioration signal S2 to the driver 41 during the energization operation of the IGBT 31 based on the present cycle of the ignition signal IGt. This enables information about a deterioration history indicative of how the definitive deterioration signal S2 is outputted to be stored in the storage circuit 50. The deterioration history indicative of how the definitive deterioration signal S2 is outputted can include whether the definitive deterioration signal S2 is outputted and/or how many times the definitive deterioration signal S2 is outputted.

The storage circuit 50 can be freely designed. For example, a memory circuit comprised of a memory cell can be used as the storage circuit 45, and the memory circuit can store the deterioration history in the memory cell. The storage circuit 50 can be comprised of Zener zap elements, and can mechanically store the deterioration history.

This configuration of the ignition apparatus 1D, which has no functions of notifying information to other devices, enables users to check the deterioration history stored in the storage circuit 50 to thereby determine how the definitive deterioration signal S2 is outputted. This therefore enables, during investigation of the ignition apparatus 1D, uses to determine whether the cause of shutdown of the igniter 10 is due to the output of the definitive deterioration signal S2. The storage circuit 50 can be configured to store history information indicative of how the deterioration detection signal S1 is outputted.

Figure 12:
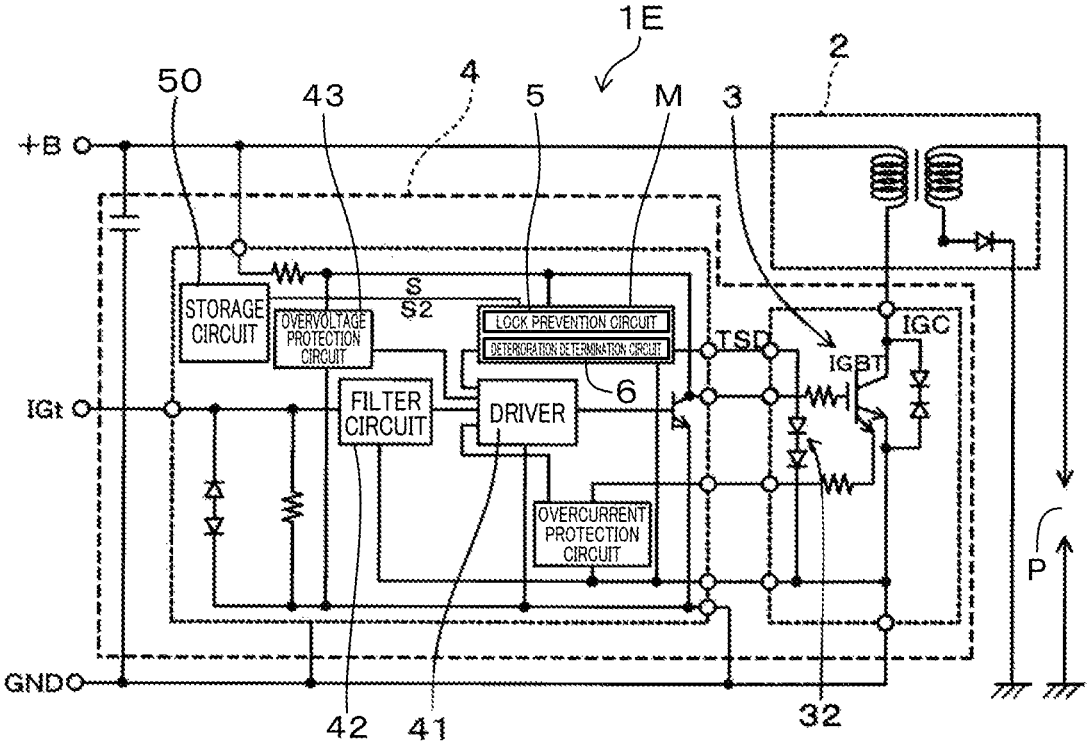
FIG. 12 is a circuit diagram illustrating an example of the configuration of an ignition apparatus according to a modification of the ignition apparatus according to the second modification.

FIG. 12 schematically illustrates an ignition apparatus 1E, which is a modification of the ignition apparatus 1D. A lock prevention circuit 5E of the ignition apparatus 1E is configured to output the overtemperature detection signal S to the storage circuit 50 while outputting the definitive deterioration signal S2 to the storage circuit 50.

This enables (i) information about a deterioration history indicative of how the definitive deterioration signal S2 is outputted and (ii) an overtemperature history of how the overtemperature detection signal S is outputted to be stored in the storage circuit 50. The deterioration history indicative of how the overtemperature detection signal S is outputted can include whether the overtemperature detection signal S is outputted and/or how many times the overtemperature detection signal S is outputted.

This configuration of the ignition apparatus 1E enables users to check the overtemperature history stored in the storage circuit 50. This therefore enables, during investigation of the ignition apparatus 1E, uses to check how the overtemperature history impacts on the lifetime of the IGBT 31 and/or on the deterioration of the IGBT 31.

As described above, each of the ignition devices 1 and 1A to 1E is comprised of the corresponding lock prevention circuit 5 for determining whether the IGBT 3 is in the overtemperature state, and the corresponding deterioration determination circuit 6, 6A for determining whether the level of the deterioration of the switching circuit 30 is within the acceptable level.

Specifically, each of the ignition devices 1 and 1A to 1E is configured to

1. Determine whether the IGBT 31 is in the overtemperature condition using the overtemperature detection circuit 52 to thereby output, to the driver 41, the overtemperature detection signal S upon determination that the IGBT 31 is in the overtemperature condition 2. Determine whether the level of the deterioration of the switching circuit 30 is higher than the acceptable level using the deterioration determination circuit 6, 6A to thereby output, to the driver 41, the deterioration detection signal S1 upon determination that, before the IGBT 31 is determined to be in the overtemperature condition, the level of the deterioration of the switching circuit 30 is higher than the acceptable level This configuration therefore makes it possible to output, to the driver 41, the deterioration detection signal S1 upon determination that the level of the deterioration of the switching circuit 30 is higher than the acceptable level before outputting of the overtemperature detection signal S to the driver 41. This configuration therefore prevents subsequent ignition operations based on subsequent ignition signals IGt inputted to the corresponding ignition apparatus after determination that the level of the deterioration of the switching circuit 30 is higher than the acceptable level. This therefore prevents preignition of the ignition plug 10 thus preventing damage to components constituting the engine 100 due to preignition.

The present disclosure is not limited to each embodiment, and therefore can be variously modified within the scope of the present disclosure. For example, the configuration of each of the control circuit and/or switching circuit of the igniter 10 can be appropriately modified. The internal combustion engine 100 is not limited to a vehicular engine, and can be appropriately modified for another machine. The configuration of each of the ignition apparatuses 1 and 1A to 1E can be appropriately modified for the configuration of an internal combustion engine to which the corresponding one of the ignition apparatuses 1 and 1A to 1E is applied.

While the illustrative embodiments and their modifications of the present disclosure have been described herein, the present disclosure is not limited to the embodiments and their modifications described herein. Specifically, the present disclosure includes any and all embodiments having modifications, omissions, combinations (e.g., of aspects across various embodiments), adaptations and/or alternatives as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. An ignition apparatus for controlling energization of a primary winding of an ignition coil to accordingly generate an ignition voltage across a secondary winding of the ignition coil, the ignition apparatus comprising:

a switching circuit comprising a switch connected to the primary winding; and a control circuit comprising:

a driver configured to control energization of the switch in response to an energization command signal inputted thereto;

an overtemperature protection circuit configured to:

monitor a temperature parameter representing a temperature of the switch;

cause the driver to energize the switch upon determination that the temperature of the switch obtained based on the monitored temperature parameter is lower than or equal to a predetermined prevention temperature; and cause the driver to shut down the energization of the switch upon determination that the temperature of the switch obtained based on the monitored temperature parameter is higher than the predetermined prevention temperature; and a deterioration determination circuit configured to perform a deterioration determination task of:

monitoring an absolute value of a change in the temperature parameter during a predetermined deterioration detection period that has been started since the energization command signal being inputted to the control circuit; and performing a comparison between the absolute value of the change in the temperature parameter and a predetermined deterioration detection threshold to thereby determine whether a level of deterioration of the switching circuit is within an acceptable level.

2. The ignition apparatus according to claim 1, wherein:

the deterioration determination circuit is configured to output a deterioration detection signal to the driver upon determination that the level of deterioration of the switching circuit is higher than the acceptable level; and the driver is configured to shut down the energization of the switch in response to receiving the deterioration detection signal.

3. The ignition apparatus according to claim 2, wherein:

the deterioration determination circuit comprises:

a generator configured to trigger generation of the predetermined deterioration detection period in response to the energization command signal being inputted to the control circuit;

a calculation circuit configured to:

calculate an initial value of the temperature parameter at the input of the energization command to the control circuit; and calculate, based on change of the temperature parameter from the initial value of the temperature parameter at the input of the energization command signal to the control circuit, the absolute value of the change in the temperature parameter;

a comparator configured to compare the absolute value of the change in the temperature parameter with the deterioration detection threshold to accordingly output the deterioration detection signal to the driver upon determination that the absolute value of the change in the temperature parameter is higher than the deterioration detection threshold; and a filter circuit configured to enable the deterioration detection signal to be passed therethrough to the driver within the deterioration detection period.

4. The ignition apparatus according to claim 2, wherein:

the deterioration determination circuit has at least one of:

a first function of notifying the deterioration detection signal to an external apparatus; and a second function of storing information about the outputting of the deterioration detection signal.

5. The ignition apparatus according to claim 1, wherein:

the deterioration detection period is set within a duration of the energization command signal inputted to the control circuit; and the deterioration detection threshold is set such that the level of deterioration of the switching circuit becomes higher than the acceptable level before the temperature of the switch obtained based on the monitored temperature parameter becomes higher than the predetermined prevention temperature.

6. The ignition apparatus according to claim 1, wherein:

the control circuit is configured to receive the energization command signal being cyclically inputted thereto; and the deterioration determination circuit is configured to:

perform the deterioration determination task for each cycle of the energization command signal being inputted to the control circuit to thereby output a deterioration detection signal upon determination that the level of deterioration of the switching circuit is higher than the acceptable level for at least one cycle of the energization command signal being inputted to the control circuit;

count the number of times the deterioration detection signal is outputted during the cycles of the energization command signal being inputted to the control circuit; and generate a definitive deterioration detection signal upon determination that the counted number has reached a predetermined number.

7. The ignition apparatus according to claim 1, wherein:

the deterioration determination circuit is further configured to determine whether the level of deterioration of the switching circuit is within the acceptable level before the switch is shut down by the overtemperature protection circuit.

8. The ignition apparatus according to claim 1, wherein:

the deterioration determination circuit is further configured to detect that the absolute value of the change in the temperature parameter of the switch becomes higher than the predetermined deterioration detection threshold even if a value of the temperature parameter itself is lower than the predetermined prevention temperature.

* * * * *